US006581879B2

(12) United States Patent
Bellacera

(10) Patent No.: US 6,581,879 B2
(45) Date of Patent: Jun. 24, 2003

(54) KITE CONTROL SYSTEMS

(76) Inventor: John D. Bellacera, P.O. Box 859, White Salmon, WA (US) 98672

( * ) Notice: Subject to any disclaimer, the term of this patent is extended or adjusted under 35 U.S.C. 154(b) by 0 days.

(21) Appl. No.: 09/990,758

(22) Filed: Nov. 16, 2001

(65) Prior Publication Data

US 2002/0084384 A1 Jul. 4, 2002

Related U.S. Application Data

(60) Provisional application No. 60/249,844, filed on Nov. 16, 2000, and provisional application No. 60/283,048, filed on Apr. 11, 2001.

(51) Int. Cl.[7] ..... B64C 31/06

(52) U.S. Cl. ..... 244/155 A; 244/155 R; 242/395; 242/388.6; 242/388.7; 242/396.8

(58) Field of Search ..... 244/155 A, 153 R, 244/142, 155 R; 242/904, 395, 395.1, 388.7, 388.6, 396.8

(56) References Cited

U.S. PATENT DOCUMENTS 2,388,478 A * 11/1945 Garber
3,338,536 A * 8/1967 Hull et al.
3,355,129 A * 11/1967 Kinsey
3,409,255 A * 11/1968 Sada
4,127,247 A * 11/1978 Strasilla
4,129,273 A * 12/1978 Hill
5,024,401 A * 6/1991 Nakashima
5,180,123 A * 1/1993 Lin
5,366,182 A * 11/1994 Roeseler et al.
6,260,803 B1 7/2001 Hunts
6,273,369 B1 8/2001 Nishimura et al.

FOREIGN PATENT DOCUMENTS

GB 1507503 * 4/1978 ..... 244/153 A
GB 2116055 * 9/1983 ..... 244/155 A

* cited by examiner

*Primary Examiner*—Tien Dinh
(74) *Attorney, Agent, or Firm*—Kolisch & Hartwell, P.C.

(57) ABSTRACT

Systems, including apparatus and methods, for controlling a power kite. The systems may include a variable-line kite controller with a rotatable spool bar carrying plural spools, or a fixed-line controller. The systems also may include deployment mechanisms, sheeting mechanisms, cleating mechanisms for the sheeting mechanisms, safety releases, line protectors, and kiteboards, among others, for use with variable- and/or fixed-line controllers.

23 Claims, 11 Drawing Sheets

KITE CONTROL SYSTEMS

CROSS-REFERENCES

This application claims the priority under 35 U.S.C. §119 of the following U.S. provisional patent applications, which are hereby incorporated by reference in their entirety for all purposes: U.S. Ser. No. 60/249,844, filed Nov. 16, 2000, and U.S. Ser. No. 60/283,048, filed Apr. 11, 2001.

RELATED REFERENCES

This application incorporates by reference in their entirety for all purposes the following U.S. Pat. No. 5,366,182, issued Nov. 22, 1994; U.S. Pat. No. 6,260,803, issued Jul. 17, 2001; and U.S. Pat. No. 6,273,369, issued Aug. 14, 2001.

FIELD OF THE INVENTION

The invention relates to kite flying. More specifically, the invention relates to systems for power-kite flying, for example, when kiteboarding.

BACKGROUND OF THE INVENTION

Power kites add a new dimension to flying kites. These large kites, with a surface area greater than about two square meters, are capable of generating substantial tractive forces. These tractive forces have been used in numerous ways to convert kite flying from an almost sedentary pastime to a fast-paced and challenging sport. For example, athletes and thrill seekers have combined power kites with boards, skis, boats, sleds, and wheeled land vessels to speed across water and land.

The large forces generated by power kites demand significant operator control throughout the flight cycle, especially when the kite is conveying the kite operator. In many cases, the kite is tethered to a hand-held control bar using a fixed-length of kite line. However, the fixed-length system complicates kite launching and subsequent kite control. For example, an assistant may be needed to position and release the kite during launching, and high-traffic areas may produce long periods of waiting for sufficient launching space, or worse, may cause tangled kites lines or injuries. Furthermore, fixed-length systems lack the ability to regulate the power of the kite. The operator cannot extend all lines together, in a regulated fashion using a brake mechanism, or sheet the kite, by changing its pitch, and thus power, through altering the relative lengths of the kite lines. A control bar that can vary either the absolute or the relative lengths of kite lengths would provide the operator with an easier, safer launch and greater control throughout the flight cycle.

At least two devices, described in U.S. Pat. No. 5,366,182 to Roeseler et al., and U.S. Pat. No. 6,260,803 to Hunts, include reeling mechanisms that allow the length of kite lines to be varied. However these devices are unsatisfactory for a number of reasons. For example, each device includes an inadequate brake mechanism. These brake mechanisms do not allow the kite operator to feel the rate of line output, and they rely on braking actions separate from steering. Thus, steering the kite may be impaired while attempting to apply the correct amount of drag or brake pressure. Furthermore, these brake mechanisms include mechanical parts that rely on friction. These parts may wear out or work less efficiently when wet. These devices also lack safety features, such as a safety release mechanism to depower the kite, a feature that is available for fixed-line systems. Overall, these devices are not easy to operate, lacking a simple mechanical design with few moving parts. As a result, these devices may result in decreased kite control, more power-kite related accidents, and more device malfunctions. Thus, safer, more efficient, and user-friendly systems for flying power kites are still needed.

SUMMARY OF THE INVENTION

The invention provides systems, including apparatus and methods, for launching, flying, releasing, landing, and/or rigging power kites. The systems may include a variable line kite controller with a rotatable spool bar carrying plural control spools, or a fixed-line controller. The systems also may include deployment, braking, sheeting, cleating, and safety release mechanisms, line protectors, line organizers, and/or kiteboards, among others, for use with variable- and/or fixed-line controllers.

DETAILED DESCRIPTION

The invention provides systems, including apparatus and methods, for launching, flying, releasing, landing, and/or rigging power kites, for use while a kite operator is stationary or conveyed across a surface. The systems include a variable-line kite controller, or control bar, that allows the operator to vary the deployed length of kite lines, while controlling the position and dynamics of a kite, particularly the height, angle, direction, and/or speed of the kite. The controller may be lightweight, easy to operate, include few moving parts, and/or may require low maintenance. The variable-line controller may include a hand-operated braking system that uses hand pressure to regulate line output, without movement of hands from a steering position. Furthermore, the variable-line kite controller may include a crank mechanism that facilitates ready retrieval and storage of kite lines after landing the kite.

The systems also may include other aspects that may be useful for both variable- and fixed-line controllers. For example, the invention provides sheeting mechanisms that allow the operator to regulate the kite's pitch, and thus the force exerted by the kite on the operator. These sheeting mechanisms may be regulated by cleating mechanisms that offer various linkage and cleating options between the sheeting mechanism, the controller, and/or the kite operator. In a further aspect, the invention provides a safety release. The safety release may be used to depower a kite and/or may function as a protective sheath to minimize operator injury caused by kite lines. In additional aspects, the invention also provides a kite board, a kite-line organizer, and methods for using systems of the invention to control a kite. The systems of the invention offer a kite operator the ability to fly a kite with increased control and safety, thus directing the sport of kiteboarding and related activities towards increased acceptance and popularity.

Further aspects of the invention are described in the following sections: (I) power kite systems; (II) variable-line kite control systems, including A) deployment mechanisms, B) locking and crank mechanisms, C) sheeting mechanisms, and D) safety mechanisms; (III) alternative variable-line control systems; (IV) fixed-line control systems; (V) kite boards; (VI) rigging and operating a kite control system, including A) rigging a kite and organizing control lines, B) launching the kite, C) sheeting the kite, and D) landing the kite and retrieving control lines; (VII) comparison of two-line and four-line kite control systems; and (VIII) further examples of kite control systems.

I. Power Kite Systems

Figure 1:
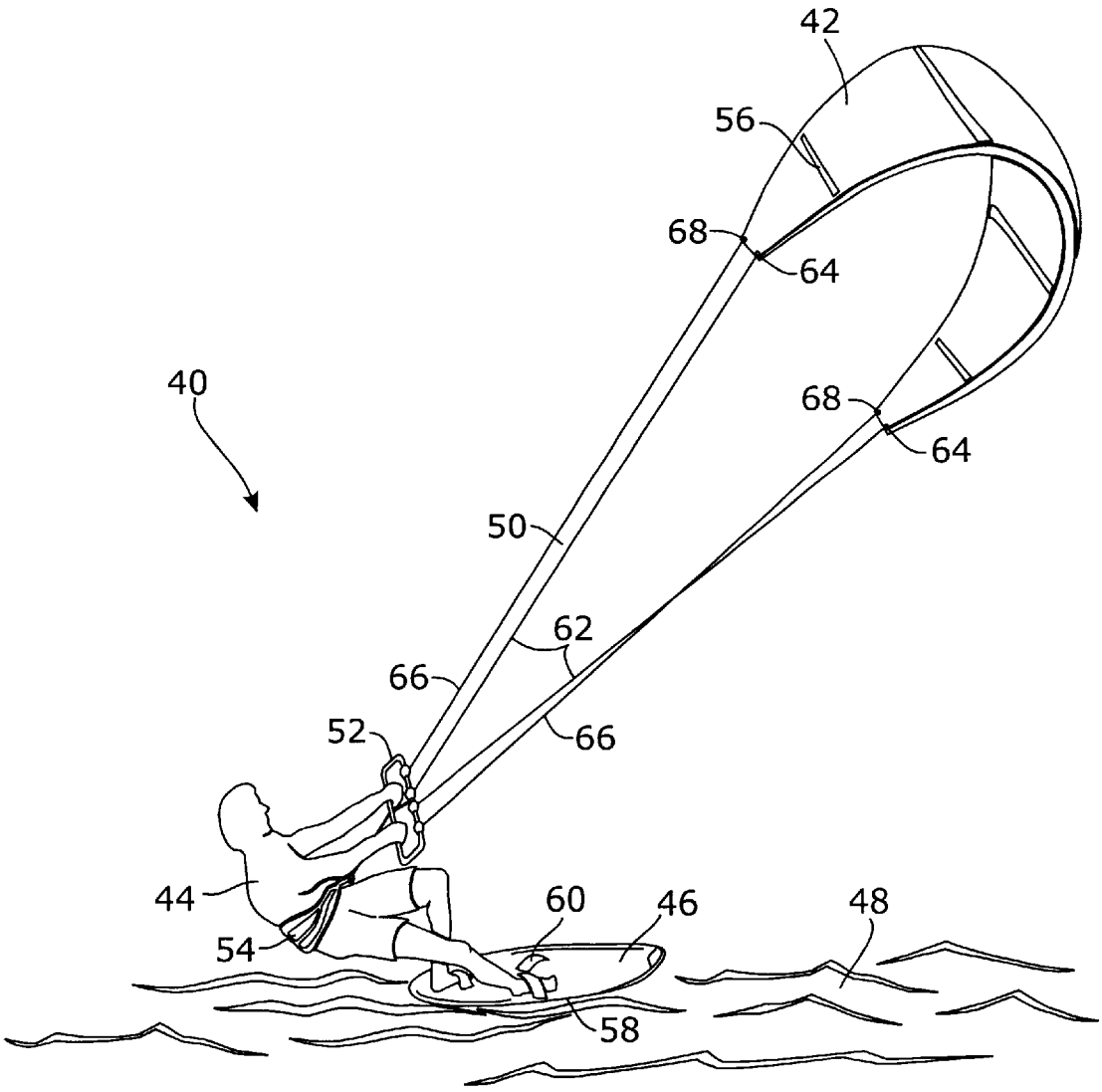
FIG. 1 is a perspective view of a person on a kite board controlling a power kite using a kite controller, in accordance with aspects of the invention.

This section describes the elements of a power kite system and how these elements are physically and functionally interconnected; see FIG. 1. In a power kite system 40, a kite 42 may be used to pull a kite operator 44 on a conveyance platform 46, in this case, a kite board, across a surface 48. The kite is connected to the operator by one or more control lines 50 (in this case, four) attached to a kite controller 52. The kite controller, also referred to as a kite control bar, may be grasped by the operator and/or linked to the operator with a harness 54 through a spreader bar with a hook or a hook-shackle combination.

The kite 42 generally comprises any tethered flying device or airfoil launched from a surface such as the ground or water and elevated above the surface by an interplay of forces provided by the wind, the control lines, and gravity. Here, wind refers to the force of moving air, which may be created by air moving relative to the kite (as in a kite flown from the ground) and/or the kite moving relative to the air (as in a kite pulled behind a boat). Wind may be at least about 10 knots up to about 40 knots or more. Power kites may be flown by a stationary operator or used to generate a tractive conveyance force and flown by a moving operator.

Kites generally have a surface-to-mass ratio sufficient to convert wind resistance into a net upward force, determined at least partially by the size, shape, and composition of the kite. The overall surface area of a kite is an important determinant of the tractive force it generates. Power kites, which generally comprise any kite large enough to pull an operator across a surface, may have an area of at least about two square meters up to much greater than twenty square meters. Such kites may have a width of about two meters to about eight meters or more. Kites may be constructed from planar sheets comprising low-density materials that impede or block airflow, including, but not limited to, cotton, paper, and/or plastics, such as polyesters (e.g., Mylar and/or Dacron), polyurethane, vinyl, and/or nylon, among others. The shape of a kite may be determined by a combination of factors, including the overall shape of the materials, and the position of supporting elements 56, such as inflatable and/or inherently rigid struts, bridles, tubes, spars, and/or battens, which provide localized rigidity or structurally link portions of the kite. Preferred supporting elements include inflatable struts, which may be inflated by mouth or by using a suitable pump, such as a hand pump. Alternatively, or in addition, kites may be constructed of an airtight material and inflated with a gas or the wind to produce a more rigid three-dimensional structure.

The kite operator 44 generally comprises any person or persons linked to the power train of the kite. The kite may be flown by a stationary or moving operator.

The conveyance platform 46 generally comprises any structure or device that can be pulled over a surface by the force of the kite. Conveyance platforms may be capable of transverse movement relative to the force generated by a kite and should be strong enough to support the weight of a kite operator. For movement on water, the conveyance platform should have a positive buoyancy in water and a surface area equal to, but generally much greater than, the surface area of the feet of the kite operator. The platform may have a tracking capability to define a direction of motion transverse to the direction of the wind, for example, provided by a fin or board edge 58 in water, by a runner on a ice, or by wheels on land. This tracking capability may allow tacking in order to return to the starting point of a kiting session. In addition, the platform may include means, such as straps 60, detachable boots, indentations, or protrusions for stabilizing the position of the operator's feet. Suitable buoyant conveyance platforms include a kite board (shown in FIGS. 1 and 20–22), a single ski or pair of skis, or a single or double-hulled boat, among others. Alternatively, the operator's feet may serve as the conveyance platform that contacts the water. In addition to water, the kite operator may be conveyed on other suitable surfaces using an appropriate conveyance platform, such as a ski, an all-terrain board, a snowboard, a sand buggy, a wheeled vehicle, roller skates, or a sled.

The surface 48 generally comprises any boundary capable of slidingly supporting a conveyance platform. Suitable surfaces may include water (shown in FIG. 1), ice, sand, packed dirt, and concrete, among others. Because the conveyance platform is selected based on its ability to be pulled readily across the surface, the surface determines the most suitable subset of conveyance platforms. For example, a board or skis may be suitable on water, a wheeled vehicle or skates may be suitable on solid surfaces such as ice, packed dirt, or concrete, and a sled may be suitable on ice or sand.

The control line 50 generally comprises any elongate tethering material capable of coupling a kite (and the force generated by the kite) to a kite controller. The control line may be a kite line that directly connects the controller to the kite or also may include a lead line, generally of greater diameter than the kite line. The lead line may link the kite line to the controller, generally being directly attached to the controller and providing a line that is more readily grasped by the operator and less likely to produce injury. The control lines may include two, three, four, or more lines attached to the kite at plural sites.

As shown in FIG. 1, plural lines may extend to the front and back of the kite: one or more central or sheeting lines 62 may extend to the front of the kite, in this case the front corners 64 of the kite, and two outer or steering lines 66 may extend to the rear corners 68 of the kite. Changing the relative lengths of control lines during kite flying, and thus the power exerted by the kite, is referred to as sheeting. Generally, sheeting is effected by changing the relative deployed lengths of control lines that extend to the front and back of the kite. Sheeting mechanisms and their use are described in more detail in Sections II.C, IV, and VI.C.

Other numbers and distributions of control lines may be suitable. For example, two steering lines and no sheeting lines may extend to the kite, and the kite may be bridled to distribute the wind's force to these steering lines. However, this arrangement of control lines generally does not allow sheeting. In some embodiments, a plurality of control lines attached to edges of a kite may extend away from the kite and unite at a position between the kite and the operator. This configuration may be used to convert a plurality of control lines attached at strategic positions such as edges to the kite into a reduced number of control lines that extend to the operator. A comparison of two- and four-line kite control systems is included in Section VII.

The magnitude of the force produced by the tethered kite, which is determined largely by the kite's surface area and the prevailing wind conditions, may guide the operator in selecting the diameter and composition of control lines. Generally, the control lines should be capable of withstanding, without breaking, the maximum force generated by the kite during normal usage. Each power kite lines is generally capable of withstanding a weight of about 300 to 600 lbs. Suitable lines may include monofilament or braided string, cord, cable, and rope, among others. Suitable materials may include plastics, cotton, and/or hemp, among others. Preferred materials may be lightweight and/or waxed and may include Dacron, Kevlar, and/or Spectra, among others. Control lines may be slightly elastic to help insulate the kite operator from sudden changes in wind speed. Moreover, control lines may include a replaceable, breakaway component, functioning like a circuit breaker, configured to break before the line if a sudden very strong pull threatens the safety of the operator or the integrity of the kite controller. Alternatively, or in addition, the control lines may include a quick disconnect that may be volitionally activated by the operator. Each control line also may include a sheath that encompasses a portion of the line and slides relative to the line. Line sheaths are described in more detail in Section II.D.

The kite controller 52 generally comprises any device for connecting the body of the operator to the pull of the control lines. The kite controller may be a variable-line device, in which the length of deployed control lines, referred to as their effective length, is variably controllable by the operator. Such a variable-line control bar has an independently rotatable portion capable of directly unspooling and rewinding the control lines along the direction of the kite (and typically along a main axis of the controller). Alternatively, the kite controller may be a fixed-line device, typically with a pre-set length of control line extended prior to launch. The kite controller may be configured so that the kite operator may directly grasp the controller with both hands to regulate the spatial orientation of the controller and thus the flight path of the kite. To effectively tether a power kite, the controller may be configured to withstand a tractive force of at least about 200 pounds. Variable-line controllers and their operation are described in more detail in Sections II, III, VI, and VII, and fixed-line controllers in Sections IV and VI.

The harness 54 generally comprises any mechanism for connecting the kite controller to the operator's body, both to disperse the force to something other than the hands and to prevent separation of the kite controller from the operator. A harness may be connected to a bridle on the controller, coupled to a sheeting mechanism, and or linked directly to the controller, using a spreader bar or a spreader-shackle combination. The harness should be strong enough to withstand the entire force generated by the kite, and generally extends around the waist and/or torso of the operator. The harness may be formed of any material having sufficient strength and/or flexibility, such as braided Dacron sleeved with flexible PVC tubing, woven nylon, and/or leather. Use of a harness to link the operator to the kite controller is described in more detail in Sections II.C–D, IV, and VI.C.

II. Variable-line Kite Control Systems

This section describes variable-line kite control systems, particularly a four-line system, that may include a four-line controller having spooling, locking, crank, sheeting, and safety mechanisms, in accordance with aspects of the invention; see FIGS. 2–15.

Figure 2:
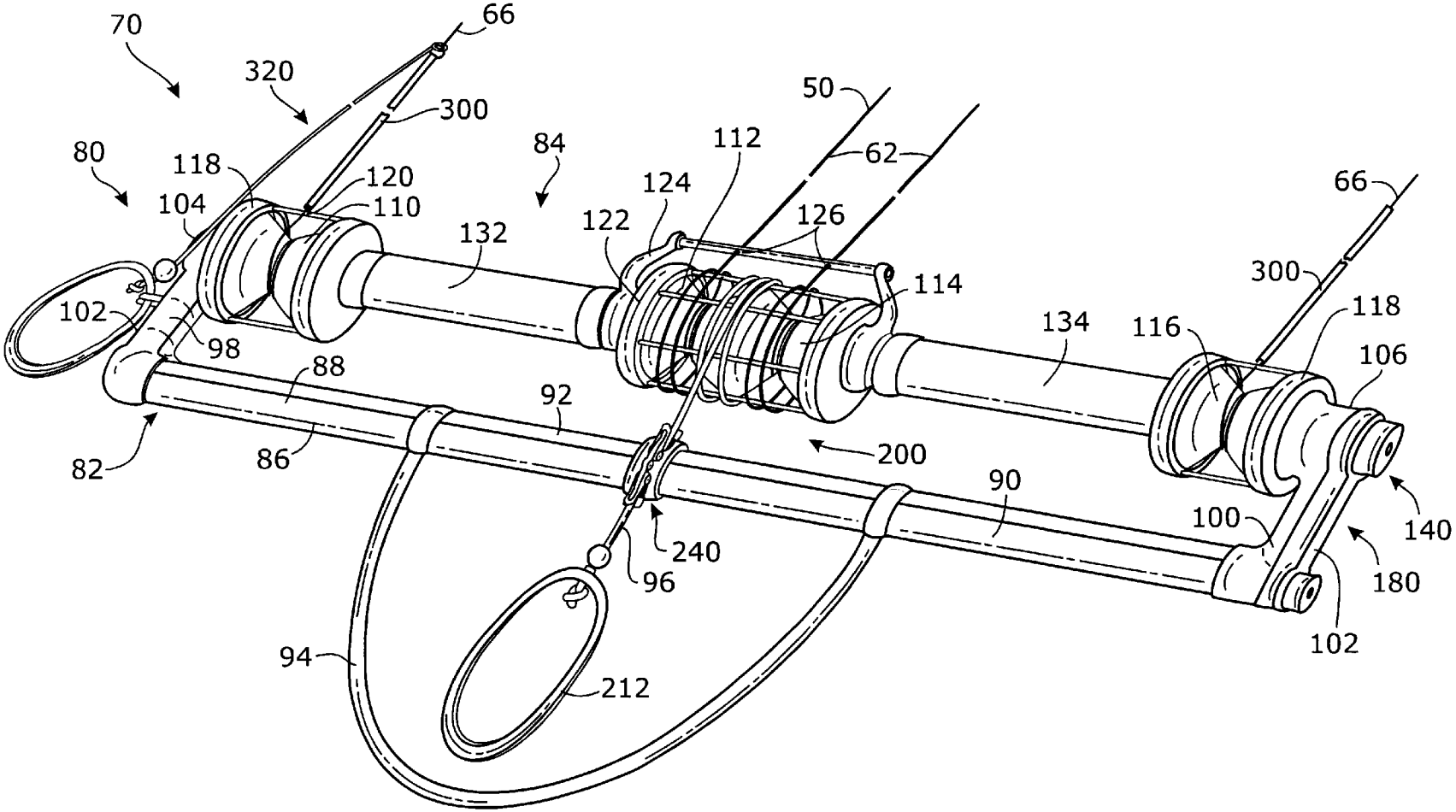
FIG. 2 is a fragmentary perspective view of a kite control system that includes a variable-line kite controller configured to hold four kite lines, in accordance with aspects of the invention.
Figure 3:
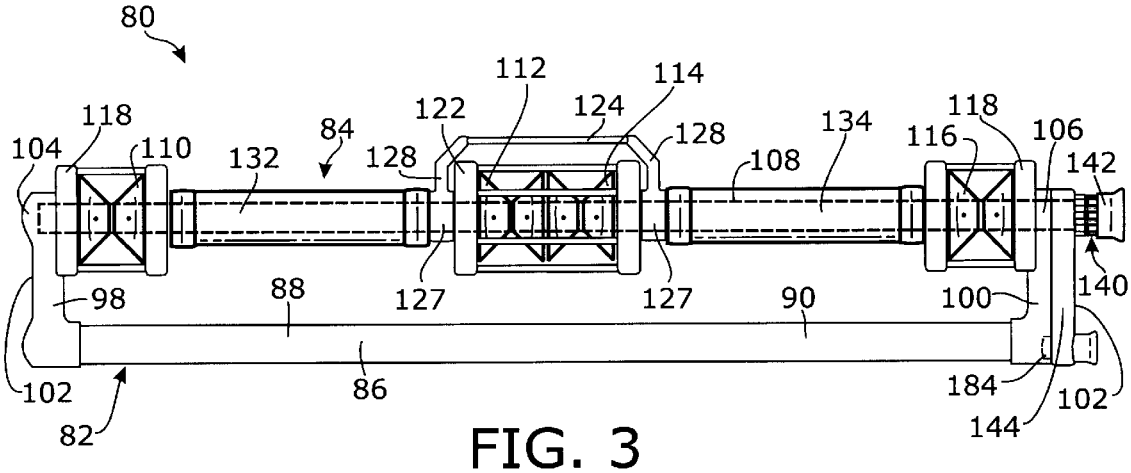
FIG. 3 is a top plan view of selected aspects of the kite controller of FIG. 2 in an unlocked configuration, showing spool bar components in bold that are mounted on, and rotationally linked to, an underlying spool-bar shaft.

A four-line kite control system 70 is shown in FIG. 2, organized by variable-line controller 80, with selected aspects shown in FIG. 3. Controller 80 includes a frame 82 holding a spool bar 84 that has an axis of rotation. The frame generally comprises any structure that supports the spool bar and which enables the operator to control the spatial position of the spool bar. The frame may be coupled directly or indirectly to the spool bar. The frame further may function to define the orientation and position of the spool bar's rotational axis, and thus the tension on control lines.

The frame includes a handle portion 86 that provides a structure for linking the operator to the controller. The handle portion may include gripping regions 88, 90 disposed along the handle portion. The gripping regions provide sites for the operator's hands to grasp the handle portion and may include a textured and/or compressible material 92, such as rubber or plastic foam, distributed partially or completely, axially and/or radially, along the gripping regions for additional comfort or to improve the operator's grip. In addition, the handle portion may provide an attachment site for a harness bridle 94 and a sheeting regulator 96, as described below. The handle portion may be spaced from spool bar 84, that is, the handle portion may have a long axis that is spaced from the rotational axis of the spool bar. Alternatively, or in addition, the handle portion may extend generally parallel to the spool bar. By spacing the handle portion from the spool bar, controller 80 may be handled much like a single bar, freeing the operator to steer the kite without interference from the spool bar. This feature may be important for performance riders, where spins, jumps, one-handed kite steering, and numerous other tricks apply.

The handle portion may include end regions 98, 100. The end regions extend generally normal (as shown in controller 80) or obliquely to the handle portion and/or the spool bar. Alternatively, or in addition, the end regions may be continuous extensions of the handle portion that bend away from the handle portion. One or both end regions may serve as winding posts around which control lines may be wound horizontally and stored as an alternative to, or in addition to, the spool bar. Retention of control lines wound around the long axis of controller 80 may be facilitated by a concave region 102 on each winding post (see FIG. 3) formed by protruding structures such as knobs, flanges, bumps, and the like. The winding posts may be designed with radius edges to prevent injury and aid in manually unwinding the line around the end posts. A distal section 104, 106 of each end region may accept an end portion of spool bar 84 to define the spool bar's axis of rotation. This combination of handle portion and end regions may improve frame stability, provide positions for hand placement; and facilitate attachment of other linkage mechanisms, such as a harness bridle and/or sheeting mechanism (see below).

The materials and dimensions of the frame may be selected based on kite size and wind strength. Each component of the frame may be constructed of strong, low-density composites comprising elements such as aluminum, titanium, and/or carbon to withstand the force generated by a power kite, at least about 200 lbs. Although the frame may have a circular or elliptical cross-section, other geometries such as rectangular may provide a suitable alternative at some or all positions along the frame. The frame may be formed integrally, with the end regions continuous with the handle portion, or the handle portion may be formed separately from the end regions. In controller 80, handle portion 86 is a tube or bar that fits into recessed portions molded in end regions 98, 100 (see FIG. 3). The width of the frame generally determines steering efficiency. Larger kites may use a wider frame, about 26" to 32"; mid-sized kites may use a frame with a width of about 22" to 26"; and small kites may use a frame with a width of about 18" to 22", particularly with high winds. Using an oversized frame with a small kite may result in oversteering the kite, thus causing the operator to flounder more often. With high winds of 30–40 knots or more, the oversized frame may be especially dangerous. In contrast, an undersized frame with a large kite provides less of a mechanical advantage and may tend to fatigue the operator rapidly.

The overall geometry of the controller may be determined by the combination of the frame and spool bar. For example, the handle portion may be joined at an angle, $90+\theta$, and the end regions joined with the spool bar at an angle of $90-\theta$, to create a trapezoidal structure. The angle $\theta$ may be positive, negative, or zero. Alternatively, either the handle portion or end regions may be partially or completely arcuate and may join at an angle up to 180 degrees. As shown in FIGS. 2 and 3, the controller may have a substantially planar, rectangular configuration. Alternatively, portions of the controller may be rounded (for example, to produce a D-shape) to reduce sharp corners that may cause injuries and/or to facilitate manufacturing. Although various sizes and weight may be suitable, overall the controller should be less dense than water so that it floats, and thus may include foamed polymers as structural fillers in some interior regions of the frame and/or spool bar. By using lightweight materials, such as carbon tubes, aluminum and lightweight alloys, nylon type plastics, and few mechanical parts, the controller weigh less than about five pounds (2.3 kg), or more typically, less than about three pounds (1.4 kg).

A. Deployment Mechanisms

The spool bar rotates relative to the frame, defining an ability for a kite controller to vary the length of the control lines. A spool bar generally comprises any structure that includes plural control spools and has a deployment mechanism capable of deploying power kite lines from a stored position. The spool bar may be elongate and may have the plural spools fixedly mounted relative to each other so that they turn together without slippage. Rotation of the spool bar about its long axis may deploy kite control lines through synchronous rotation of control spools. Thus, the control line leaves and enters the control spool along the direction of the kite, reducing stresses associated with deploying the line laterally, as in some prior art devices.

A control spool generally comprises any structure capable of anchoring a control line and directly storing and deploying the control line through rotational motion. Spools function as components of the spool bar, guiding an incoming or outgoing control line onto or off of a rotating spool bar, respectively. Spools may have an increased diameter at their lateral edges to bias spooling of the control line toward more central regions of the spool. Any change in the diameter of the spool along its rotational axis may be gradual, to produce a contoured profile, or discontinuous, to produce a stepwise profile. Control spools are deep enough to hold a desired length of control line, generally kite lines rather than lead lines. Furthermore, spools may be constructed of any suitable material that is strong and lightweight, such as an aluminum alloy, a composite, and/or plastic.

The structure of spool bar 84 of controller 80 is shown in FIGS. 2 and 3. However, for the following discussion, please refer particularly to FIG. 3, which illustrates, in bold, coupled, synchronously rotating components of the spool bar. Spool bar 84 may include a shaft 108 (shown dotted), extending between recesses formed on frame 82, generally defined by end regions 98, 100. Shaft 108 provides a rotatable platform on which spool bar spool bar may be attached to each other without a unifying shaft for support.

Spool bar 84 includes plural spools 110, 112, 114, 116 fixedly mounted on shaft 108. Thus, these four spools rotate synchronously. Each spool carries one of four control lines 50 from a kite. Front or sheeting lines 62 typically extend to central spools 112, 114 and rear, steering lines 66 to outer or lateral spools 110, 116.

Each spool may be surrounded by a housing. A housing generally comprises any frame or other structure that at least partially encloses a spool and may protect and/or position control lines. A housing may be coupled to the frame and/or spool bar. When coupled to the spool bar, the housing may be freely rotatable relative to the spool bar. The housing may be composed of a lightweight material, such as plastic or an aluminum alloy. Furthermore, this material may be partially or substantially transparent, for example, when the housing substantially covers the spool to facilitate monitoring the disposition of the control lines on the spools. The housing generally includes a site for guiding the control line to the spool. For example, the housing may include an aperture, guide, or roller, such as, a brass or aluminum eyelet or a nylon roller, through or over which the control line may be unwound and rewound. The housing may help to exclude dirt and other debris from the line and spool and may protect the operator from hand injury.

Spool housings on controller 80 are shown in FIG. 3 (see also FIGS. 2, 6, 7, and 9). Lateral spools 110, 116 each include a lateral housing 118 that is attached to an end region (98 or 100). In some embodiments, the housing may be an extension of the end region that at least partially covers portions of the spool proximal to the operator. Each lateral housing 118 may include an aperture 120 (see FIG. 2) to guide steering line 66.

Central housing 122 may surround both central spools 112, 114. However, in contrast to each lateral housing, the central housing is generally not attached to the frame 82, but is coupled to spool bar 84 so that the housing is rotatable relative to the spool bar and spools. The central housing may include apertures or guides that direct control lines to and from the central spools (described below).

Figure 7:
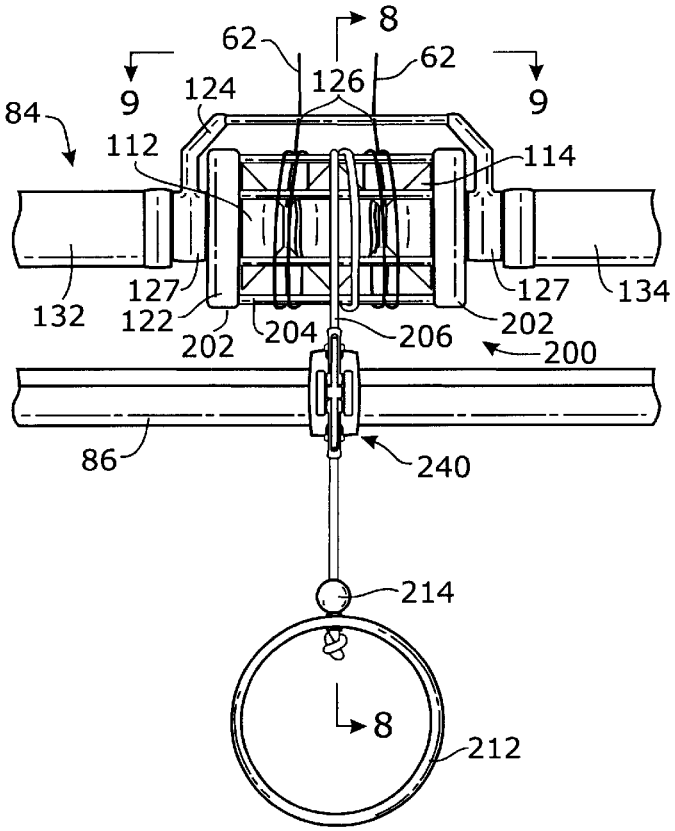
FIG. 7 is a fragmentary, top plan view of the kite controller of FIG. 2, illustrating aspects of the sheeting mechanism.
Figure 9:
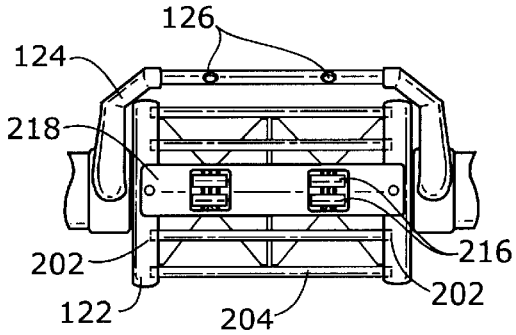
FIG. 9 is a fragmentary, side elevation view showing selected aspects of the sheeting mechanism and related features of the kite controller of FIG. 2, viewed generally along line 9—9 of FIG. 7.

Control lines extending from the central spools also may be positioned by a floating guide 124 carrying apertures or guides 126 (FIGS. 2, 7, and 9). The apertures may be oversized, allowing easy passage of the kite lines. Floating guide 124 includes sleeves 127 joined to arms 128 (FIG. 3). The sleeves flank the central housing 122 and central spools 112, 114, with the arms extending to meet on a side of the housing and spools. Floating guide 124 rotates freely relative to central housing 122 and spool bar 84 in order minimize friction during kite control, steering, and sheeting (see below). For example, the floating guide may keep the control lines in alignment and extend kiteward from the controller when the control lines are wound over the spool housing, during kite sheeting. The roles of the central housing and the floating guide in sheeting mechanisms are described in more detail in Section II.C below.

The kite controller may include a brake mechanism. A brake mechanism generally comprises any mechanism for impeding or blocking the rotation of the spool bar. The brake mechanism may couple rotation of the spool bar to the frame. For example, the brake mechanism may provide regulated frictional contact between a region of the spool bar and the frame. This frictional braking contact may be between a stationary component of the frame and an end or circumferential portion of the spool bar. In distinct braking modes, the spool bar may rotate freely, rotate with impeded motion, or be substantially locked in position, unable to rotate.

Alternatively, the brake may directly link rotation of the spool bar to the operator. In this case, the spool bar may also include a brake region, such as brake regions 132, 134 of controller 80, shown in FIGS. 2 and 3. A brake region generally comprises any control region of the spool bar configured to be grasped by a hand of the operator in order to regulate or stop the rotation of the spool bar through frictional contact between the hand and the spool bar. The brake regions may be positioned and dimensioned to allow the operator to support the kite controller and steer the kite while regulating the release of control lines, without moving the hands. For example, brake regions may be used during a kite launch or for re-adjustment of line length due to changed wind conditions. Furthermore, brake regions may have an increased diameter, contoured surface, and/or distinct material to improve applying the brakes. For example, the brake regions may have a coating that is rubber or a plastic mesh, although a smooth, bare surface such as an anodized aluminum or polished carbon fiber may be more suitable due to its lower abrasiveness, especially when wet.

Figure 4:
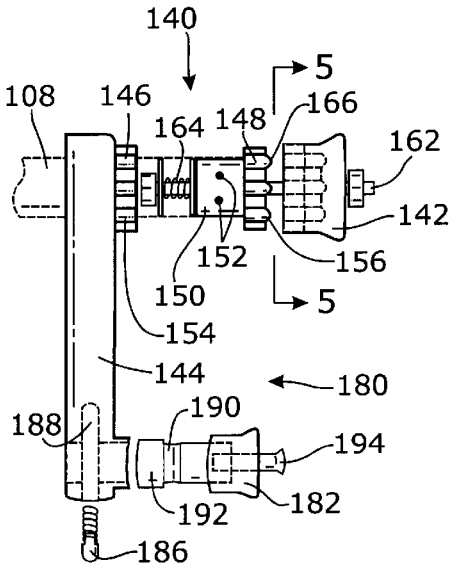
FIG. 4 is an exploded, fragmentary view of the kite controller of FIG. 2, illustrating locking and crank mechanisms that control the spool bar.
Figure 5:
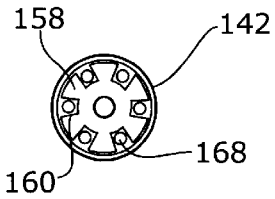
FIG. 5 is a side elevation view of FIG. 4, viewed generally along line 5—5 of FIG. 4.

FIGS. 3 and 4 illustrate further aspects of spool bar components and structure. In FIG. 3, components that are rotationally linked on spool bar 84 are shown in bold lines. Thus, the four spools and the brake regions revolve synchronously, whereas the housings 18, 122 and floating guide 124 either do not rotate relative to the frame or are rotatable independent from the spool bar. Shaft 108 defines the central axis of the spool bar and extends into each end region of the frame. The shaft may provide an attachment site for each spool and brake region along the shaft's axis. In contrast, the shaft may extend through rotationally unlinked components, such as the spool housings and the floating guide, but is generally not secured to these unlinked components.

B. Locking and Crank Mechanisms

The spool bar may have a locking mechanism to convert the spool bar between a locked and a freely rotating, unlocked configuration. The locking mechanism may be any structure or assembly that links rotation of the spool bar directly or indirectly to rotation of the frame. The locking mechanism may have a binary configuration that either locks or unlocks rotation of the spool bar.

Controller 80 includes a binary locking mechanism 140 that links rotation of the spool bar to the frame through a crank arm attached to the frame; see FIGS. 2–6. Locking mechanism 140 positions a movable switch 142, in this case a knob, either in (FIG. 6), or out of (FIG. 3), contact with frame 82 and spool bar 84. An axial portion of arm 144 may define a retention structure 146 on the frame, in this case an arm gear, which is coaxial with a spool bar retention structure 148, in this case a spool-bar gear (see FIG. 4). Gears 146 and 148 are attached to, or integral with, crank arm 144 and spool bar 84, respectively. In this example, arm gear 146 is formed integrally with the crank arm, whereas spool-bar gear 148 includes a base 150 that extends inside of shaft 108 and is fixed in position with fasteners 152. Teeth 154, 156 of gears 146 and 148 are alignable, so that a complementary recess 158, defined in part by teeth 160 inside of knob 142, fits over (and generally conceals) the aligned gears to fix the position of the gears relative to each other and lock the spool bar in place. Knob 142 is spring-biased to this locked position, by a fastener 162 that extends through the knob and gear 148 and positions a spring 164 adjacent to base portion 150.

The spool bar may be unlocked and locked as follows. To unlock the spool bar, an axially directed, outward force on knob 142 compresses spring 164, allowing the knob to slide outward to the unlocked position of FIG. 3. Teeth 154 of arm gear 146 may be slightly undersized relative to teeth 156 of spool-bar gear 148 to facilitate movement of the knob while the control lines are under tension; manual back-and-forth rotational rocking of the spool bar may allow the knob to be moved more easily. In this unlocked position, teeth 160 of knob 142, no longer contact both gears. Once positioned free of the gears, the knob may be rotated slightly to maintain the knob in this extended position. Slight rotation and then release aligns and mates protrusions 166 (on the outer face of gear 148) with recesses 168 on knob teeth 160. Additional outward pressure on the knob, coupled with slight rotation and then release will return the knob back to its locked position.

The kite controller may include a crank mechanism, also referred to as a crank. A crank mechanism generally comprises any manually powered mechanism that provides a mechanical advantage for rotating the spool bar to wind a control line onto a spool. The crank may be attached to the frame. The crank also may be constantly or switchably coupled rotationally to the spool bar and/or frame, and may provide bi-directional, one-to-one control of spool bar rotation. Alternatively, the crank may be geared relative to the spool bar, so that one revolution of the crank produces fewer or more than one revolution of the spool bar. The ratio of revolutions between the handle and the spool bar may be fixed or variable. Rather than bi-directional, the crank may be uni-directional in its winding action, for example, acting through a ratchet, similar to that found on a socket wrench. In addition to directing an active spool mechanism, the uptake crank also may actively or passively coupled to unwinding of lines and/or may be used as a brake.

Figure 6:
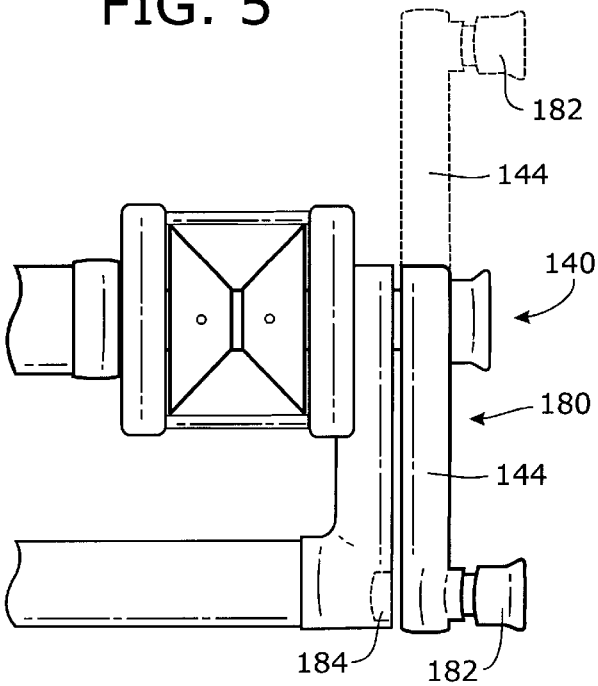
FIG. 6 is a fragmentary, top plan view of the kite controller of FIG. 2, showing the crank mechanism's stored and released positions.

The crank mechanism 180 may be in the form of an arm 144 extending generally normal to the spool bar axis, with a handle 182 on it distal aspect; see FIGS. 3, 4, and 6. Similar to spool bar 84, the crank may have locked and unlocked configurations. In the locked configuration, the crank is fixed in position relative to the frame. This locked configuration may act as a storage position, shown in FIG. 3, in which the arm is disposed adjacent to end region 100. As described above, this locked configuration may be used to fix the position of the spool bar. The locked configuration may be defined by a movable portion of the crank mechanism, in this case handle 182. As shown in FIGS. 3, 4, and 6, handle 182 may extend through a hole in the crank arm into a recess 184 in the frame, to prevent crank mechanism 180 from rotating. Outward movement of handle 182 to the unlocked position of FIG. 6 may allow arm 144 to rotate, as shown in dotted outline. The amount of outward force required for outward movement of the handle may be determined by a detention mechanism, such as spring-biased detention pin 186 stored in recess 188 of arm 144. Pin 186 retains handle 182 in the locked configuration by protruding into channel 190 until a sufficient outwardly directed force on the handle retracts pin 186 out of the channel. Complete separation of the handle from arm 144 may be blocked by an enlarged portion of the handle formed in base 192. In other embodiments, a feature of the crank mechanism separate from the handle may be used to produce a locked configuration.

In the unlocked configuration, base portion 192 is disengaged from recess 184. The crank is then rotatable about the axis of the spool bar. Handle 182 may be joined to base portion 192 with a fastener 194 so that the handle rotates freely relative to the crank arm, making the winding motion easier. As described above, knob 142 may be engaged to rotationally couple arm gear 146 to spool bar 84. In this engaged position, rotation of crank mechanism 180 also rotates the spool bar and thus may be used to wind control lines on (or off) the spools.

C. Sheeting Mechanisms

This section describes sheeting mechanisms that may be used with a variable-line kite controller; see FIGS. 7–12.

Since kiteboarding and related activities with a power kite are conducted in a range of wind conditions, a sheeting mechanism is preferred to control the power exerted by the wind. A sheeting mechanism generally comprises any mechanism that allows the kite operator to independently regulate the effective or deployed length of a subset of control lines. The deployed length measures the distance from the controller to an attachment site on the kite, along one of the control lines. Generally, the sheeting mechanism is used to alter the pitch of the kite, thus changing the amount of wind "spilled" and the force generated by the kite. With a spool bar having fixedly mounted spools, the sheeting mechanism may wind one or plural control lines around the spool bar without rotating the spool bar. This may be effected with an independently rotatable structure such as a housing that acts as a sheeting spool, distinct from the control spools. The sheeting spool may define a distinct path for winding control lines that is of larger diameter, generally radial to the path defined by control spools mounted on the spool bar.

Figure 8:
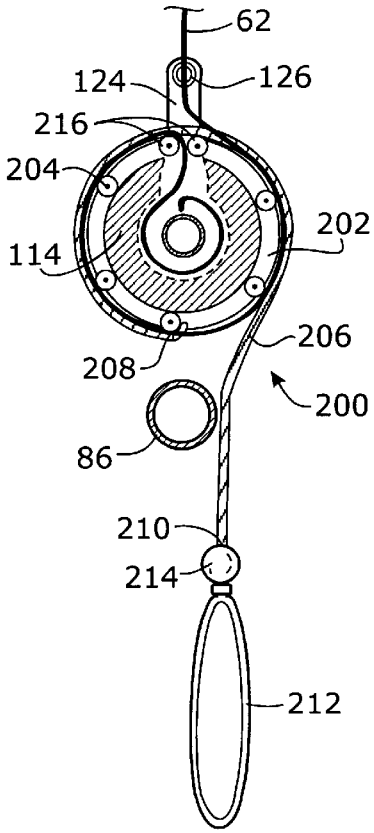
FIG. 8 is a partially cross-sectional view of selected aspects of FIG. 7, taken generally along line 8—8 of FIG. 7.

A sheeting mechanism 200 used in kite control system 70 may include a sheeting spool controlled by a sheeting regulator; see FIGS. 2, 7, and 8. Mechanism 200 uses the central housing as the sheeting spool 122. As described above, sheeting spool 122 is rotatably mounted on the spool bar. Spool 122 may include hubs 202 coupled to spool bar 84, with line supports 204 that connect the hubs, extending generally orthogonal to sheeting lines 62. A sheeting regulator 206 is coupled to sheeting spool 122, generally secured directly, for example, with an end portion fastened to one of the line supports, shown at 208 in FIG. 8. The sheeting regulator generally comprises any flexible structure that transmits longitudinally directed forces on the regulator to the sheeting spool and may include a line, cord, string, belt, or strip, among others. The sheeting regulator may be wrapped radially, generally at least one or more times, around the sheeting spool, over the line supports, as shown in FIGS. 7 and 8. The length of sheeting regulator that is wrapped around the sheeting spool may determine the maximum extent of sheeting for the kite. The sheeting regulator extends away from the sheeting spool, adjacent or through handle portion 86, or toward the operator. A distal end portion 210 of the sheeting regulator is typically attached to a sheeting linkage structure 212, or sheeting loop, such as a ring, loop, or handle, among others, which allows the operator to define the longitudinal position of the sheeting regulator. The linkage structure may be controlled by grasping it with a hand and/or attaching it to a harness, for example, through a harness hook or a releasable shackle. A retainer 214, such as a bead or knot, may be disposed proximal to the linkage structure to limit travel of the sheeting regulator.

Rotation of the sheeting spool determines the deployed length of sheeting lines. As shown in FIGS. 7 and 8, sheeting spool 122 provides secondary winding paths for sheeting lines 62. These winding paths are radial to primary winding paths around control spools 112, 114. Thus, as the sheeting spool rotates clockwise in FIG. 8, sheeting lines 62 are brought in through guide 126 of arm 124 and wound onto the sheeting spool, shortening the deployed length of sheeting lines, relative to the steering lines. Floating guide 124 (with apertures 126) generally points kiteward. In contrast, the line guides 216 on the sheeting spool move with the housing and define the angular position at which the sheeting lines extend onto the sheeting spool.

Rotation of the sheeting spool is determined by a balance of opposing forces, in effect, producing a two-way pulley system. One of the forces is defined by the tension on the sheeting regulator, directed longitudinally away from the kite, either by attachment of the sheeting regulator to frame 82 or to the operator. This force tends to rotate the sheeting spool clockwise in FIG. 8. A second, opposing force is supplied by sheeting lines 62, which exert a kiteward force. This second force tends to rotate the sheeting spool counterclockwise in FIG. 8.

The kite operator may control sheeting by adjusting the balance between these opposing forces. Sheeting action may be mediated by moving sheeting loop 212 toward or away from the kite. As shown in FIG. 8, movement of loop 212 toward the operator will rotate the sheeting spool clockwise relative to the spool bar, unwinding a portion of the sheeting regulator from the sheeting spool, and thus coiling sheeting lines 62 onto the sheeting spool. This action will shorten the deployed length of the sheeting lines relative to the steering lines. In contrast, kiteward movement of the sheeting loop will spool the sheeting regulator onto the sheeting spool and concomitantly unwind the sheeting lines from the sheeting spool, thus increasing the effective length of the sheeting lines, generally providing more kite power. Complete removal of the force exerted through the sheeting regulator generally will cause the sheeting lines to completely unspool from the sheeting spool, producing alignment between guides 126 and 216, and return to an unsheeted configuration.

Movement of control lines in and out may produce significant frictional wear on the control lines. To minimize this wear, particularly during sheeting, the sheeting spool, lateral housing, and/or other line guides, may guide the control lines through rollers 216. The rollers may be cylinders pivotably coupled to a housing. For example, on housing 122, rollers 216 are mounted on pins (not shown) that are attached to a roller support 218 extending between hubs 202 (see FIG. 9). Support 218 may also hold a second set of orthogonal rollers or guide pins disposed above or below rollers 216 and limiting lateral movement of control lines. Sliding movement of a control line over a roller will cause the roller to rotate about its long axis, thus minimizing frictional wear on the line. In addition, a roller may provide a smooth sheeting motion, where the operator can feel the amount of pull from the kite and adjust accordingly. The rollers may be formed of plastic, metal, or other suitable materials and also may act as guides for one or more lateral housings 118 or for floating guide 124.

Figure 10:
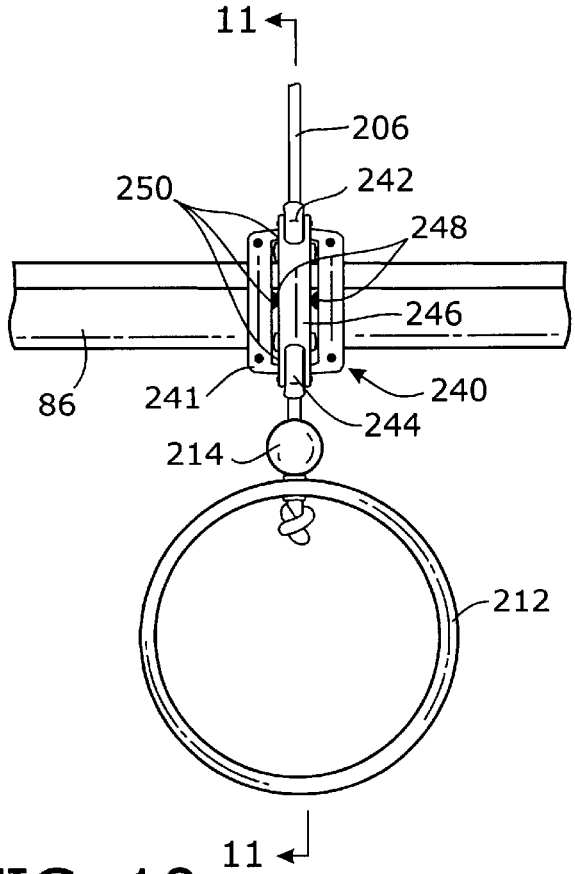
FIG. 10 is a fragmentary, top plan view of the kite controller of FIG. 2, showing a bi-directional cleating mechanism used to regulate the sheeting mechanism, in accordance with aspects of the invention.
Figure 11:
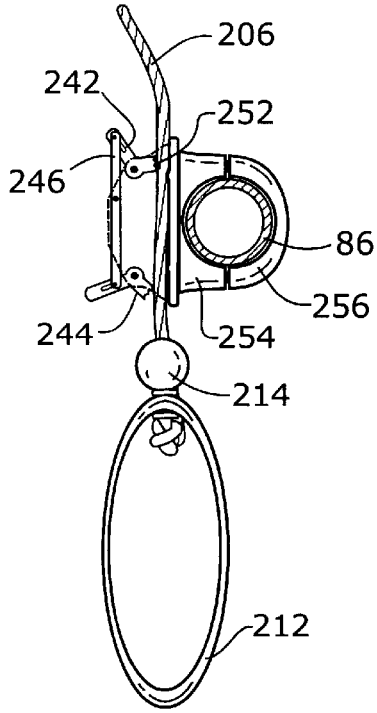
FIG. 11 is a fragmentary, cross-sectional view of FIG. 10, taken generally along line 11—11 of FIG. 10.
Figure 12:
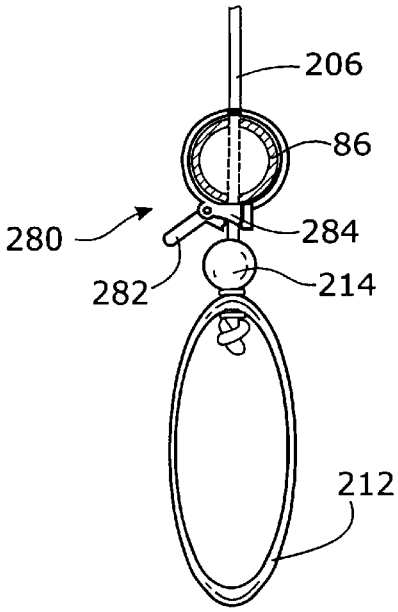
FIG. 12 is a fragmentary, cross-sectional view of an embodiment of a uni-directional cleating mechanism that may be used to control a sheeting mechanism, in accordance with aspects of the invention.

The position of sheeting regulator 206 may be defined longitudinally and guided by a cleating mechanism; see FIGS. 10–12. A cleating mechanism generally comprises any mechanism that at least uni-directionally blocks longitudinal movement of the sheeting regulator. The cleating mechanism may be a structure that allows the sheeting regulator to be fixed in position adjacent to a region of the kite controller, such as the handle portion or other frame region. For example, the cleating mechanism may be a clamp, channel, post, or recess, among others, that bi-directionally holds the cleating mechanism in place. Alternatively, the cleating mechanism may act uni-directionally. In this case, the mechanism may prevent longitudinal sliding of the sheeting regulator in one direction, but allow it to slide in response to tension in the opposing direction.

A three-position cleating mechanism 240 may be included on controller 80, attached to handle portion 86; see FIGS. 10–11. Cleating mechanism 240 includes a housing 241, which may guide the sheeting regulator, defining the lateral position of the regulator. Mechanism 240 may include opposing cleating arms 242, 244, which act uni-directionally and are pivotably attached to the housing. Each cleating arm has a locking position, in engagement with sheeting regulator 206, and a released position, out of engagement with the regulator. Connector 246 may act to positionally interconnect the two cleating arms. In this embodiment, connector 246 has three mutually exclusive functional positions, which are occupied alternately by sliding connector 246 along its long axis. By sliding the connector, retention pins 248 seat in one of three sets of recesses 250 disposed along the connector to define these three functional positions. FIG. 11 illustrates one of these three positions, in which only cleating arm 242 is engaged with regulator 206. In this engaged position, longitudinal movement of sheeting regulator 206 away from the kite (downward in this figure) is blocked by angled teeth 252 of arm 242, which rotate into locking engagement with regulator 206. In contrast, kiteward sliding movement of regulator 206 is permitted because angled teeth 252 are positioned so that cleating arm 242 rotates slightly (counterclockwise in FIG. 11) to allow the regulator to pass. Cleating arm 244 is not in an active position and does not block longitudinal sliding in either direction. In a second, intermediate position of connector 246 (not shown), neither cleating arm is engaged, allowing bi-directional, unconstrained movement of regulator 206. In a third position of lever 246 (not shown), cleating arm 244 is engaged, but arm 242 is not, allowing uni-directional sliding of regulator 206, but in the opposing direction to that allowed by the first position. In alternative embodiments, connector 246 may have only two positions, in which either arm, 242 or 244, is engaged. Alternatively, connector 246 may have four functional positions, adding a fourth position relative to mechanism 240, in which both arms are simultaneously engaged, thus locking the position of regulator 206.

Cleating mechanism 240 may be attached to controller 80 as an add-on accessory. For example, as shown in FIG. 11, the housing may be attached to a clamp having clamp portions 254, 256. These clamp portions be may joined and tightened with fasteners around handle portion 86 to fix the position of mechanism 240 on controller 80. Alternatively, the cleating mechanism may be directly fastened to the handle portion with threadable fasteners such as bolts or screws, adhesives, or welding, among others.

A two-position cleating mechanism 280 may be included as part of a sheeting mechanism; see FIG. 12. Here, mechanism 280 includes a single cleating arm 282 pivotably attached to supports 284. Similar to the action of each cleating arm described above, arm 282 may be positioned in engagement with sheeting regulator 206 to effect a uni-directional block to regulator sliding, or arm 282 may be positioned out of engagement to allow unconstrained, bi-directional sliding of regulator 206. In FIG. 12, regulator 206 is guided by holes in handle portion 86, rather than adjacent the handle portion by a housing, as shown in FIG. 11. The handle portion may include a flanged surface to prevent the regulator from being frayed or damaged otherwise.

The two-, three- and four-position unidirectional cleating mechanisms described above provide the kite operator with several options based on cleating preference. 1) A two-position cleating mechanism may be used by a kite operator who prefers to ride solely in either the harness bridle or the sheeting loop. The bridle rider may mount the two-position cleating mechanism as shown in FIG. 12. The rider may then pull the sheeting loop and cleat it at a desired position and continue riding in the harness. In contrast, the sheeting-loop rider might reverse-mount the two-position cleating mechanism relative to FIG. 12, to prevent the cleating mechanism from readjusting with every small movement made by the rider. In this reversed position the rider acts as the resistance between the sheeting mechanism and the kite. 2) The three-position cleating mechanism 240 of FIGS. 10 and 11 may give the kite operator the option to ride in either the harness bridle or the sheeting loop at any given time, and an additional, unconstrained position in which the sheeting regulator is freely slidable. This unconstrained position may be used by a sheeting-loop rider who wants to have continual bi-directional control over the sheeting mechanism. 3) A four-position cleating mechanism may eliminate the need for a harness bridle by also providing a bi-directional, fixed position for the regulator, allowing the sheeting loop to function as a harness bridle.

D. Safety Mechanisms

Safety is a prominent issue in the design of any kite control system. Thus, kite control system 70 may include safety mechanisms that protect the operator from injury during flying and depowering phases of a kite-flying session; see FIGS. 13–15. Safety mechanisms may include line sheaths, and a safety release that may function in conjunction with a line sheath.

Figure 13:
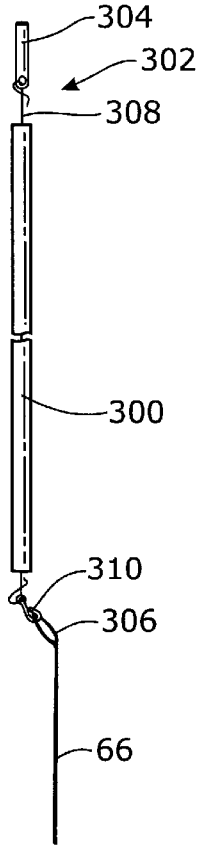
FIG. 13 is a view of a line feeder positioning a kite line relative to a component of the safety release mechanism of FIG. 14, in accordance with aspects of the invention.

As shown in FIG. 13, line sheaths 300 are elongate tubes with an inner diameter that is greater than the diameter of the control line, to allow the control line to pass through the sheath easily. Line sheaths may be slidably positioned over any control lines 50, generally a proximal portion of one or plural outer (steering) lines 66. To thread a control line through sheath 300, a line feeder mechanism 302 may be used. Mechanism 302 may include a cylinder 304 or other structure that is easily passed through sheath 300. Cylinder 304 may be weighted and/or elongate, and may be pushed through the sheath by gravity or an applied force. Cylinder 304 is attached to an end region 306 of control line 66, for example, with a connecting line 308 tied to a hole at one end of cylinder 304 and connected to control line 66 either directly for by attachment with a blunt hook 310. Alternatively, cylinder 304 may be directly attached to control line 66. After cylinder 304 is passed through the sheath, control line 66 follows due to its attachment to the cylinder and then may be attached to the kite (or controller) directly or indirectly.

The size and composition of sheaths may be selected based on functional considerations. As mentioned above, the inner diameter is selected to allow the sheath to slide easily over the control line. The outer diameter of each sheath may be sufficiently large to minimize injury by distributing a lateral force exerted by the control line over a larger area defined by the sheath relative to the control line. The length of each sheath may be at least about 6", 1 ft. or 2 ft for protection from the control line, or at least about half the width of the kite (generally, at least about six feet) for depowering the kite, as described below. Sheaths may be somewhat flexible to facilitate storage, but, when included in the safety release mechanism described below, should be sufficiently rigid to withstand a force applied longitudinally. A suitable material may be a plastic, such as reinforced PVC tubing.

Figure 14:
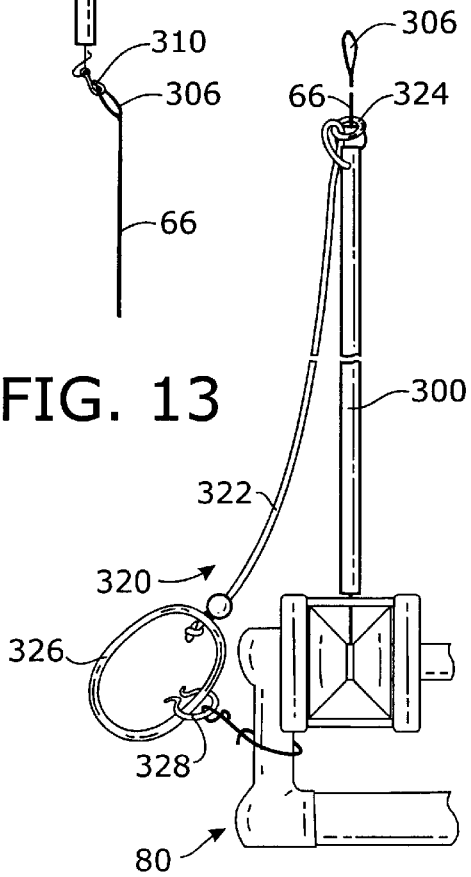
FIG. 14 is a fragmentary, top plan view of a safety release mechanism disposed on the kite controller of FIG. 2, in accordance with aspects of the invention.
Figure 15:
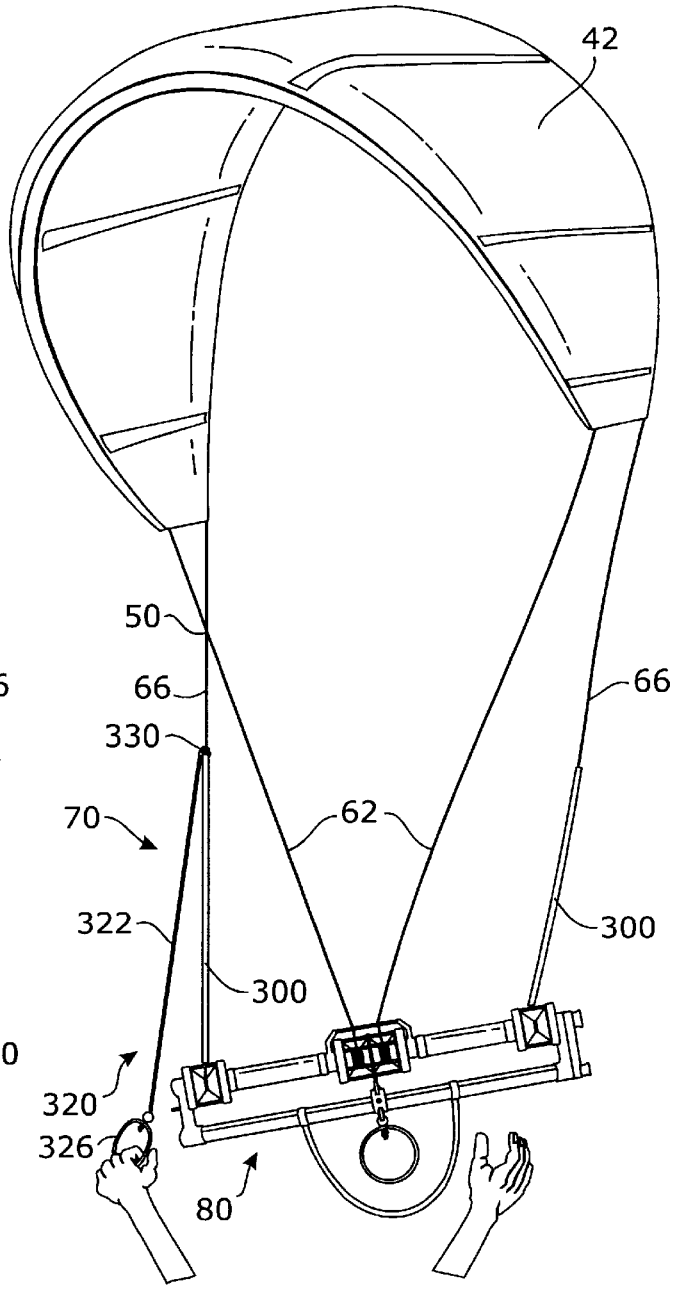
FIG. 15 is a view of the safety release mechanism of FIG. 14 being deployed in the system of FIG. 1 as the kiteboarder releases the kite controller, in accordance with aspects of the invention.

As shown in FIGS. 14 and 15, each sheath generally remains proximal to controller 80 during kite operation. Each sheath may be maintained in this proximal position adjacent to the spools by the action of gravity, floating on the control lines, neither connected to the control lines or the controller. However, in some embodiments, the proximal end of the sheath may be mounted on the controller, for example with an adhesive, or the sheath may be more flexibly maintained in association with the controller, for example with tethers connecting the controller to a region of the sheath.

The sheaths may perform at least two functions. First, as mentioned above, each sheath may increase the effective diameter of control lines proximal to the controller, thus reducing the risk of injury from small-diameter control lines. Thus, use of sheaths may allow kite lines to be directly attached to the spools, without the need for bulky intervening lead lines of greater diameter. Therefore, line sheaths may eliminate a need for storing lead lines on spools, thereby reducing spool size and circumventing a need to unspool control line to a minimum length to deploy attached lead lines. Second, a sheath may be a component of a release mechanism, for example, when the operator is unable to control the kite and unlinks from the handle portion of the controller.

A safety release mechanism 320 may form part of kite control system 70; see FIGS. 14 and 15. Mechanism 320 includes a release line 322 that is slidably attached to control line 66, for example, with ring 324, a bead, or a loop, among others, joined near or at the end of the release line. The proximal end portion of the release line may include a release handle 326, such as a loop, a ring, or other easily grasped structure. Handle 326, or a proximal portion of line 322, may be coupled to controller 80 with a clip 328 from which the handle can be easily removed, or a ring through which the release line can be slid. Alternatively, the release line may extend through an aperture in a region of the controller frame, such as one of the winding posts. In other embodiments, the proximal end portion of release line 322 may be continually attached to the operator, rather than, or in addition to, the controller. For example, the release line may include a operator attachment feature such as a wrist leash, or other a strap or attachment structure that is configured to attach to the wrist, other body part, or harness of the operator. To minimize tangling of the release line or interference with kite control, the release line may include an inherent spring-like coiled structure, which is readily expandable. The release line may be slightly or substantially greater than the length of sheath 300, generally about six feet to about twelve feet, and more preferably about nine feet.

A controller may be configured to include a release handle or a wrist leash based on operator skill. The wrist leash may be suitable for beginner-level to intermediate-level kite operators, since kite handling skills are still being developed. Thus, when an uncomfortable or dangerous situation arises, the operator is able to down the kite by letting go of the kite controller. As kite flying skills develop, becoming more second nature, the release handle system may be more suitable. This type of safety mechanism frees the kite operator's hands to perform tricks such as spins, inverts, and a number of transitions.

Safety release mechanism 320 may function as shown in FIG. 15. The kite operator grasps release handle 326 and unlinks otherwise from the kite controller. Alternatively, with a wrist strap or similar attachment structure, the operator simply releases the kite controller. Once released, the distal end of the sheath provides a pivot point 330 at which tension from the release line is applied, which offsets the control lines and depowers the kite. Thus, when the controller is released, the operator maintains connection to the kite through the release line. The use of a release line to depower a kite, suitable lengths for the release line, and suitable positions for the pivot point are described in more detail in U.S. Pat. No. 6,273,369, issued Aug. 14, 2001, which is incorporated by reference herein.

III. Alternative Variable-Line Control Systems

Figure 16:
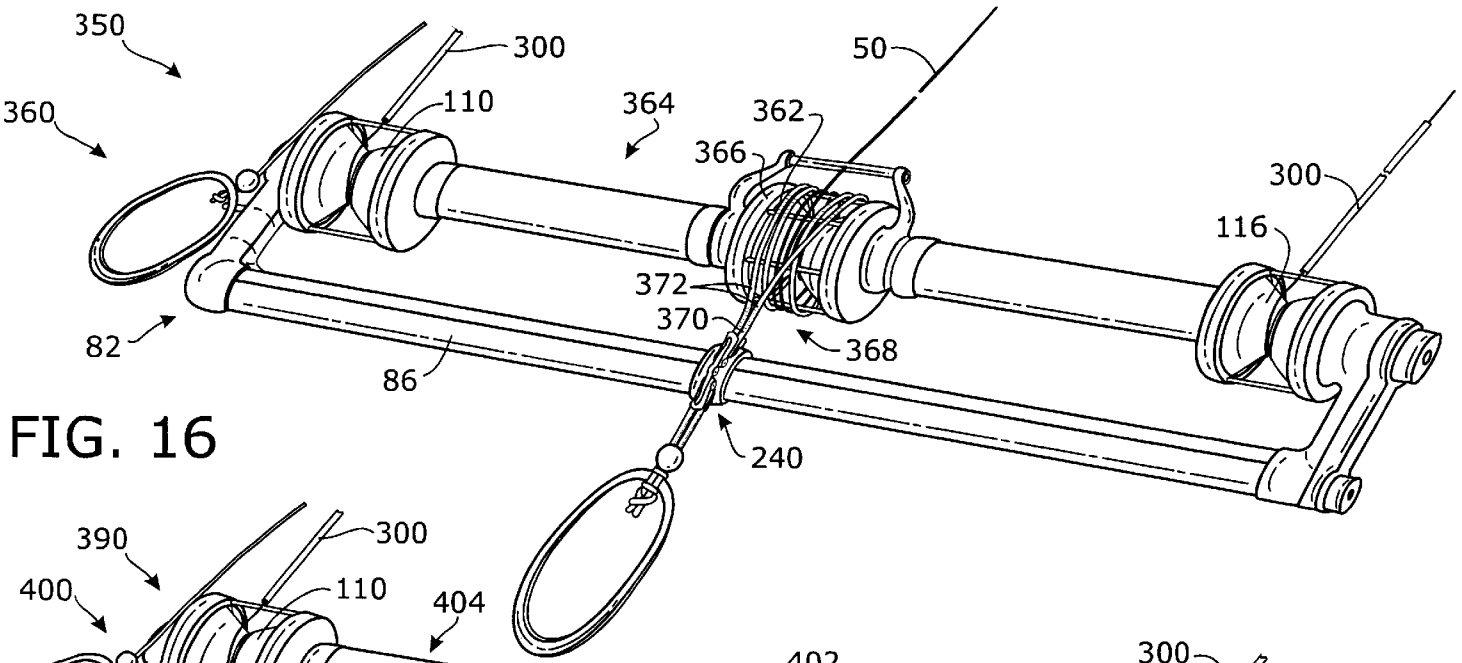
FIG. 16 is a fragmentary perspective view of a kite control system that includes a variable-line kite controller configured to hold three kite lines, in accordance with aspects of the invention.
Figure 17:
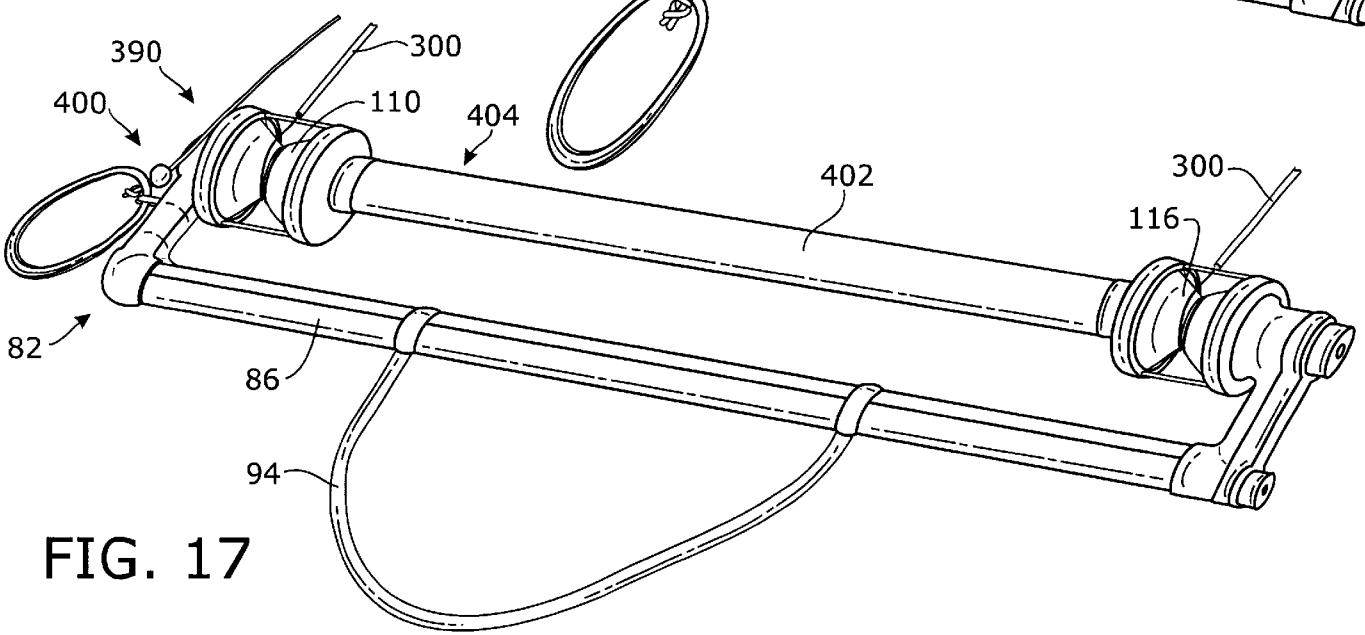
FIG. 17 is a fragmentary perspective view of a kite control system that includes a variable-line kite controller configured to hold two kite lines, in accordance with aspects of the invention.

This section describes other examples of variable-line control systems, which include three-spool and two-spool controllers; see FIGS. 16–17.

Other kite controls systems may use variable-line controllers configured to hold fewer or greater than four lines. For example, as shown in FIG. 16, system 350 includes controller 360 having three spools 110, 116, 362 disposed along spool bar 364. Central spool 362 may be surrounded by a housing that acts as a sheeting spool 366 in sheeting mechanism 368. Sheeting regulator 370 may include two sheeting cords 372 that wind around sheeting spool 366 and extend through cleating mechanism 240. With this arrangement, the central sheeting line 50 may wind centrally on sheeting spool 366, whereas sheeting cords 372 may wind laterally, flanking the sheeting line. In other embodiments, the sheeting regulator may be formed by a single sheeting cord.

As shown in FIG. 17, kite control system 390 includes a controller 400 having two lateral 110, 116 but no centrally disposed spools and thus no sheeting mechanism. Brake region 402 may extend uninterrupted between the spools on spool bar 404.

Both controller 360 and 400 may use the same frame 82 to support spool bars 364 and 404, respectively. Frame 82 also supports spool bar 84 in controller 80. Thus, a single frame may accept plural distinct spool bars with varying numbers of spools, but with a common length. As a result, a relatively small number of distinct frame widths may be sufficient to accept a corresponding number of spool bar lengths, but an unlimited number of spool configurations. Similarly, plural frames of varying shapes, but of a common width, may be produced that accept and support a single spool bar.

IV. Fixed-line Control Bar

Figure 18:
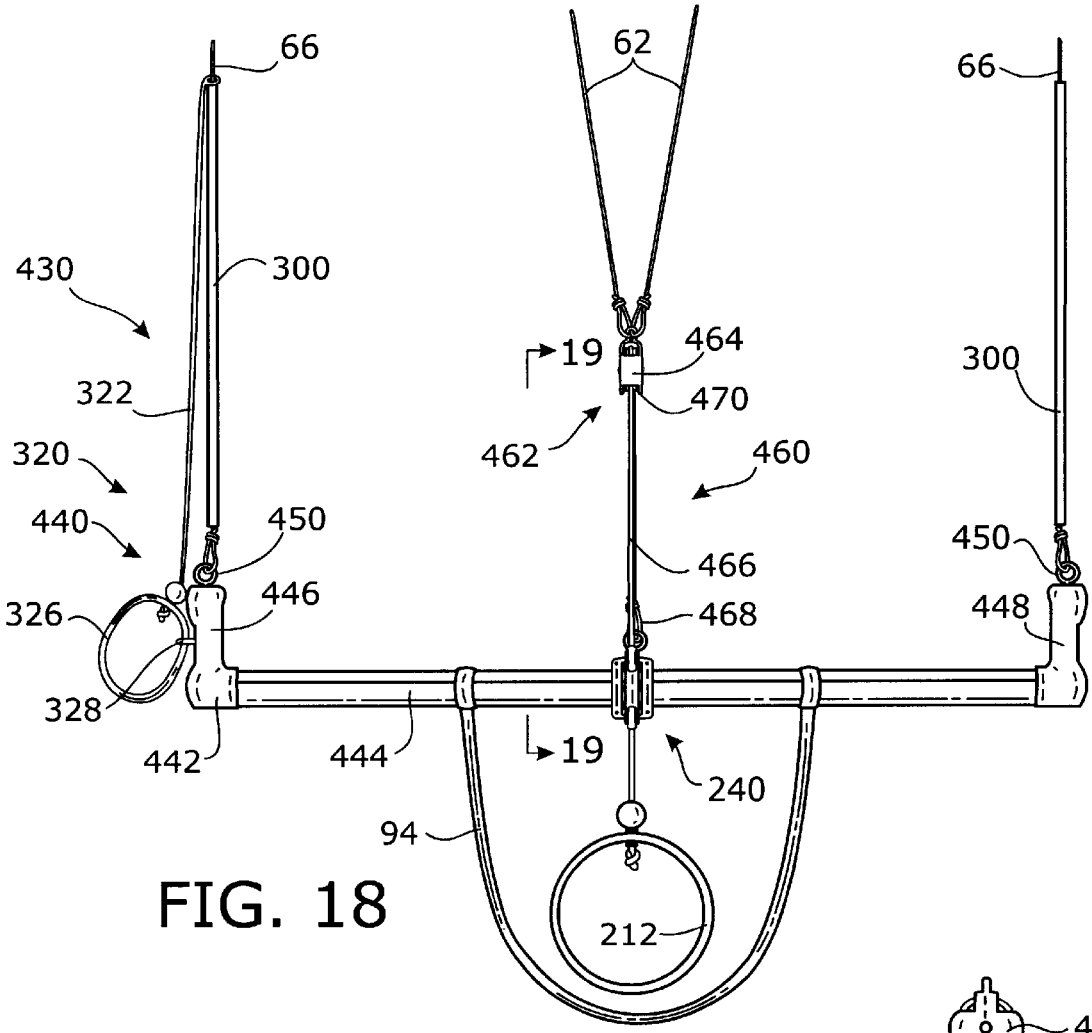
FIG. 18 is a fragmentary, top plan view of a kite control system that includes a fixed-line kite controller with a sheeting mechanism, in accordance with aspects of the invention.
Figure 19:
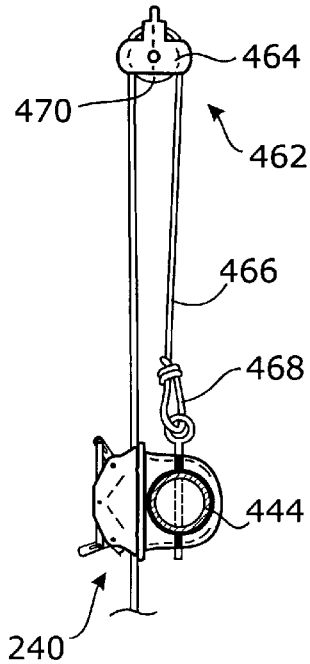
FIG. 19 is a view of FIG. 18 taken generally along line 19—19 of FIG. 18, showing a pulley mechanism used in a sheeting mechanism.

This section describes a fixed-line kite control system having a fixed line control bar with a sheeting mechanism; see FIGS. 18–19.

Kite control system 430 attaches four kite lines (generally without lead lines) to kite controller 440. Similar to variable-line controller 80, fixed-line controller 440 accepts steering lines 66 at lateral positions and is coupled to sheeting lines 62 at a central position. However, rather than being attached to a spool bar, these kite lines are coupled to frame 442. Frame 442 includes a handle portion 444 and winding posts 446, 448 that accept steering lines 66. Lines 66 may be attached to screw eyes 450 or other loops extending from the winding posts, may extend through apertures in the winding posts themselves, or may be attached suitably otherwise. System 430 may include sheaths 300 and safety release mechanism 320.

System 430 may include a sheeting mechanism 460 to control the relative lengths of the kite lines. Sheeting mechanism 460 may include a pulley mechanism 462 that provides a mechanical advantage for sheeting. The pulley mechanism includes a pulley housing 464 to which end portions of the sheeting lines 62 are attached. A sheeting regulator 466, such as a line, cord, or belt, among others, is attached at or near an end portion 468 to cleating mechanism 240 (or frame 444). Regulator 466 extends around pulley wheel 470 and then back through cleating mechanism 240. As a result, housing 464 is acted on by opposing forces: a kiteward force from sheeting lines 62 and a force directed toward the controller by the sheeting regulator. Movement of the sheeting loop 212 toward or away from the kite increases or decreases, respectively, the effective lengths of the sheeting lines, but by a ratio of 2:1 for sheeting loop movement relative to the change in the effective length of the sheeting lines. Thus, appropriate movement of the sheeting loop coupled with action of the cleating mechanism sheets the kite. In other embodiments, the sheeting regulator may be attached to the sheeting lines without a pulley wheel, so that a change in longitudinal position of the sheeting regulator (and sheeting loop) produces an equal change in the effective length of the sheeting lines (1:1 ratio). Alternatively, other ratios between sheeting regulator and sheeting line movement may be produced with different numbers of pulley wheels and/or gears. Use of a harness bridle, sheeting loop, and a cleating mechanism to sheet the kite are described in more detail in Sections II.C and VI.C.

V. Kite Board

Figure 20:
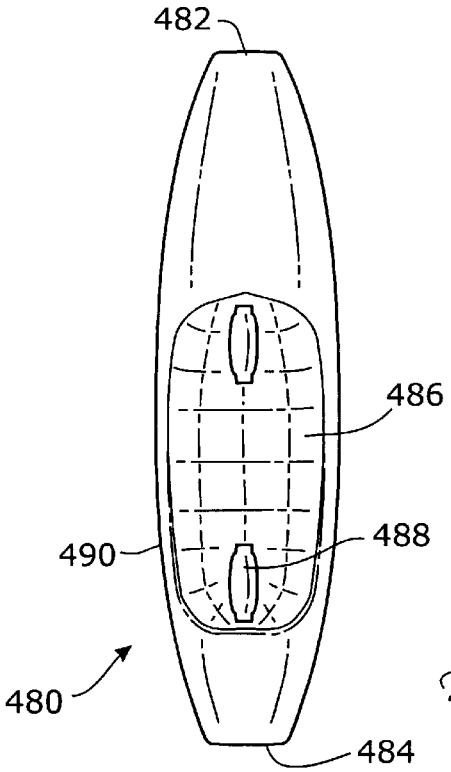
FIG. 20 is a top plan view of a kite board for use in power kite systems, in accordance with aspects of the invention.
Figure 21:
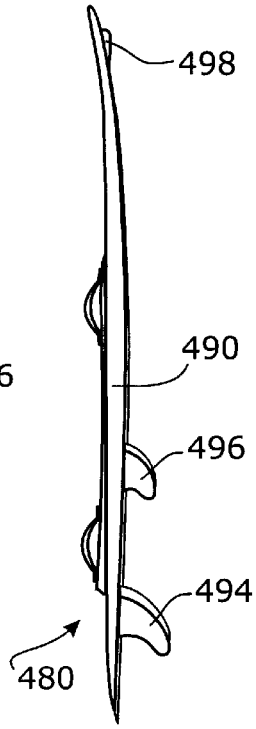
FIG. 21 is a side view of the kite board of FIG. 20.
Figure 22:
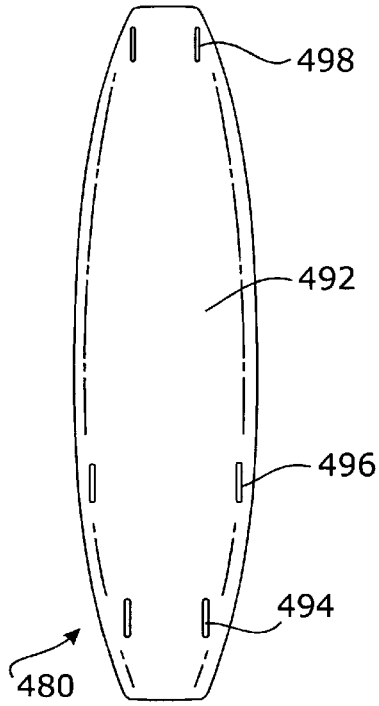
FIG. 22 is a bottom view of the kite board of FIG. 20.

This section describes a board for conveying an operator during flying a power kite; see FIGS. 20–22.

Various conveyance structures have been used with power kites on water. For example, skis have been employed, but lack enough surface area for most water conditions, especially at windward tacks and in rough waters. Wakeboards that are designed to carry a rider behind a boat also have gained some popularity for use with power kites. However, these boards lack an ergonomic foot stance to steer the board, because the foot positions are centered longitudinally on the board. Also, these boards lack a substantial tracking fin to create a sufficient resistance to the kite's pull. Therefore, a board is needed that more specifically meets the needs of a kite operator. Specifically, the board needs a proper foil with sufficient surface area to enable a kiteboarder to plane-up quickly and remain on top of the water during lulls in the wind.

As shown in FIGS. 20–22, kite board 480 is properly foiled with an effective edge, similar to a wakeboard-surfboard hybrid. The foiled edge, along with properly placed fins, enables the kiteboarder to efficiently resist the pull of the kite and travel at all points of sail. Kite board 480 includes a tip 482 and a tail 484, positioned at the front and the back of the board, respectively, when running with the wind. The top of the board has a wedge-scooped pad 486 that is asymmetrically positioned on board 480. Foot straps 488 extend upward from pad 486, providing generally orthogonal positioning of the operator's feet relative to the long axis of the board. Each lateral edge 490 of the board has a foiled configuration that promotes maneuverability on the water. Three pairs of fins extend generally normal to the bottom surface 492 of the board. The skeg fins 494 are positioned at the rear of the board, the fore fins 496 in front of the skeg fins, and the switch fins 498 near the front of the board. Switch fins 498 may allow the kiteboarder to reverse the direction of board travel, thus placing the switch fins at the back of the board during tacking. As a result, switch fins 498 may provide the kiteboarder with increased tracking and steering capability when tacking. Board 480 may be formed of a foam core covered with a fiberglass composite.

VI. Rigging and Operating a Kite Control System

This section describes how kite control systems of the invention, including fixed-line and variable line controllers, may be rigged and operated, particularly for kiteboarding; see FIGS. 23–28.

A. Rigging a Kite and Organizing Control Lines

Figure 23:
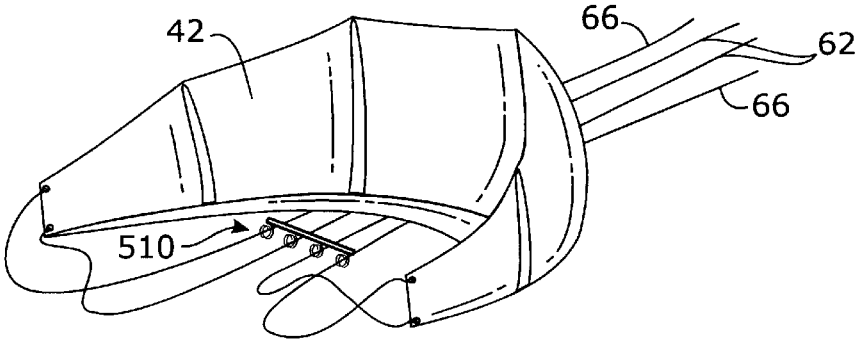
FIG. 23 is view of a line slider for organizing kite lines, in accordance with aspects of the invention.
Figure 24:
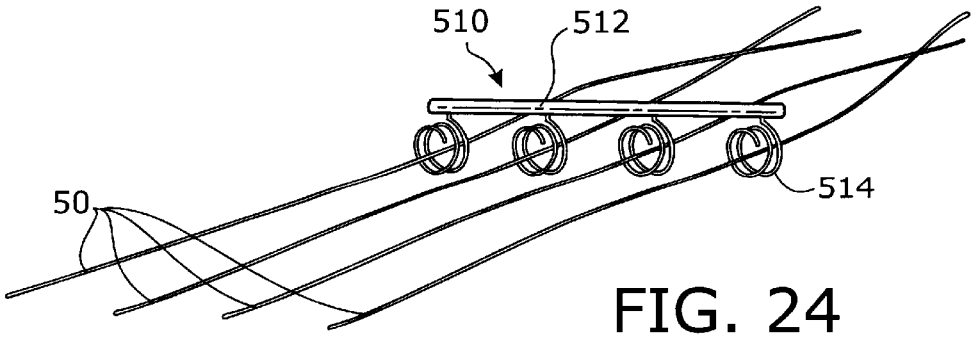
FIG. 24 is a perspective view of the line slider of FIG. 23.

This section describes how control lines may be attached to a kite and a kite control bar using a line stretcher and/or a line feeder to assist in measuring and organizing control lines; see FIGS. 23–24.

Two-, three-, and four-line kite controllers generally use equal lengths for the control lines that extend between the controller and kite. Line equalization may be achieved by accurately measuring each individual line to exact lengths. However, slight differences may still exist, due to line stretching. Even slight differences may cause the kite to steer incorrectly, favoring one side, or, worse still, spiral out of control. To more precisely equalize line lengths, a line stretcher may be used (not shown). Such a stretcher may be produced by fixedly positioning plural hooks along a bar, so that the hook spacing matches the spool or attachment-site spacing on the controller. After securing the line stretcher to a fixed object, the kite lines are attached to the line stretcher, and the desired full length of each kite line is laid out and tied to the kite controller. Once lines are tied, the lines are stretched by pulling the controller away from the line stretcher. Discrepancies in line length are exhibited as line sag, which may be corrected by retying the appropriate lines.

Attaching lines in the correct spatial relationship between a kite controller and a three-, four-, or more-line kite may be important. If done incorrectly, the kite may spiral out of control, potentially taking the operator along too, if the operator is hooked into the harness. To avoid this problem, a line slider may be used, as shown in FIGS. 23 and 24. Line slider 510 has a frame 512 with plural line guides 514. The frame may be a bar, a tube, a beam, or any other generally linear support structure. The frame may be relatively small, such as a bar of about ¼" to about ½" diameter, with a length of about 4" to about 10". A specific embodiment has a diameter of ⅜" and a length of 6". The plural line guides (in this case four, to match the four lines) may be in the form of spaced, helical or spring-like coils. Generally, at least about one-and-one-half coils, about two coils, or about two and a half coils may be sufficient to hold kite line 50 in place within the guide. The coils are spaced at least enough for the kite lines to slide easily through adjacent coils.

Guides 514 of line slider 510 allow a middle portion of each kite line to be positioned within the central hole of each guide, without threading from the end of the kite line. Furthermore, this positioning can be reversed and the line removed from the guide at any position along the kite line after the kite lines have been rigged to the kite. To position each kite line on a line guide, a middle portion of the line may be introduced at one side or between any of the coils and then wrapped around the guide to follow the direction of the coils. To remove, the procedure is reversed. Alternatively, before rigging, an end of the kite line may be directly threaded through the central hole of the guide.

Once all four lines are in the center of the coils, one can slide the line slider the length of the lines, removing any twists ahead, while keeping proper spacing behind. These twists may result from storing kite lines on winding posts of a kite controller, in which case each line might have twists extending throughout its stored length. Once these twists are removed, the line slider may remain on the kite lines until the kite is rigged correctly. Alternatively, the operator may wish to attach the line slider before the kite is unrigged, allowing the operator to wind the kite lines around the winding posts until reaching the kite, then unrigging the kite but leaving the line slider still attached to the kite lines. In this case, the line slider would act as a line organizer to mark the relative position of each line. Thus, the operator may not have to slide the line slider the length of the lines to correctly rig the kite prior to a new kite flying session.

B. Launching the Kite

Figure 25:
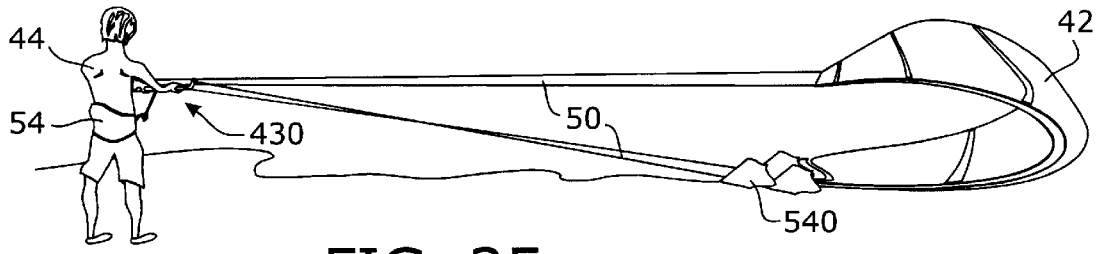
FIG. 25 is a view of a kite control system positioned for self-launching a kite with control lines extended, in accordance with aspects of the invention.
Figure 26:
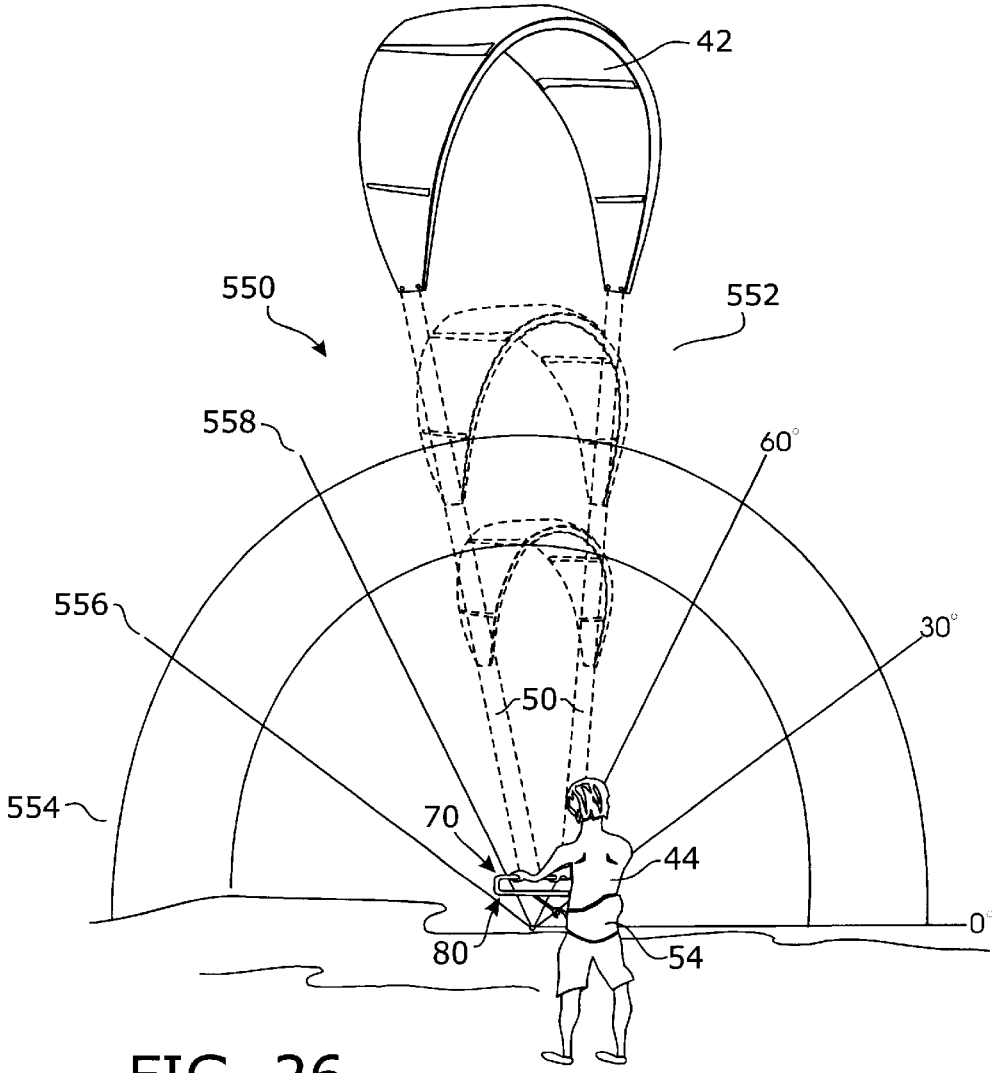
FIG. 26 is a schematic view of a person extending kite lines for a power kite using the variable-line kite controller of FIG. 2, showing the relative positions of four wind zones, in accordance with aspects of the invention.
Figure 27:
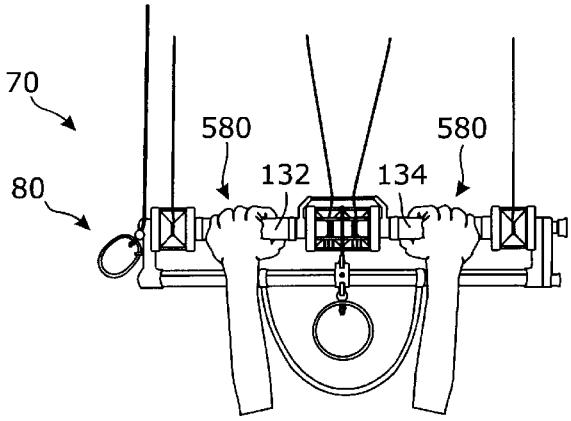
FIG. 27 is a fragmentary, top plan view of the kite control system of FIG. 2, with a kiteboarder's hands operating the brake mechanism during a kite launch, in accordance with aspects of the invention.

This section describes the launching phase of kite flying, particularly self-launching with either a fixed-line or variable-line controller; see FIGS. 25–27. For the purposes of this disclosure, launching includes lifting a kite from the ground so that the kite is supported by the wind, and, with the use of a variable-line controller, extending control lines with optional hand braking to a desired length.

A method for self-launching a kite is shown in FIG. 25. This method may be used for either fixed- or variable-line controllers, but is generally more suited for a fixed-line controller. This method may be used when ideal circumstances apply, such as unregulated wide-open areas, or long stretches of beach, but when an assistant is not available. Here, the kite is held in position by piling sand 540 on a corner of the kite and/or on the control lines. The kite operator then extends the control lines and the kite is held in a generally upright position by tension on the control lines coupled with force of the wind. By pulling the controller, the kite is dislodged from the sand and begins to fly.

Self-launching may be greatly facilitated by using a variable-line controller, such as control bars 80, 360, or 400. FIG. 26 shows early phases of kite flying within a wind window 550 after launching with variable-line kite control system 70. As indicated, the kite may be launched by the operator with very short lengths of control lines extended. The operator may allow the wind to carry the kite upward in the neutral zone 552, generally avoiding the turbulent zone 554, the power zone 556 and moderate zone 558 as control lines are extended. The kite positioned in the neutral zone of the wind window minimizes horizontal forces on the operator and achieves maximum kite stability. In contrast, launching a kite with fixed lines generally requires that the kite climb through the turbulent, power, and moderate zones with the control lines fully extended. The ability to launch the kite with short lengths of control lines extended may provide a mechanism for launching the kite in close proximity to the operator in congested, high traffic areas, frequently without assistance, and an ability subsequently to extend the control lines to increase kite mobility, stability, and force generation.

FIGS. 25 and 26 show the kite operator lacking a conveyance device. However, a variable-line controller may allow the operator to launch the kite in the water while positioned with feet in the straps of a kite board or with the board positioned nearby, for example, using board 480 of FIG. 20. Board 480 is designed to plane up quickly when the kite is maneuvered into power zone 556.

FIG. 27 illustrates hand position 580 that may be used during kite launching and extension of control lines from the controller. Hand position 580 places hands on the spool bar, with each hand grasping a brake region 132, 134. This hand positions allows the operator to steer the kite and control the rate of line output (brake the kite) at the same time without moving the hands or fingers laterally. Brake regions 132, 134 provide the controller with a braking system that is generally effective, simple in design, and easy to use. In addition, the braking system is safe because it minimizes the tendency to lose control of steering. The forces exerted by the kite are the same amount one experiences during a kiting session. By applying a moderate squeezing-type grip after the spool bar has been unlocked to allow free rotation (see Section II.B), the operator can regulate the amount of kite line, and the speed of output, by simply stopping or slowing the rotation of the spool bar. This is referred to as feathering the kite out. Feathering the kite depends on wind velocities. Typically, the first 15 meters requires the most feathering attention as the kite climbs through turbulent zone 554, near the surface of the water. With proper feathering, the kite only exerts partial force on the control lines and still flies true. After 15 meters the kite becomes more stable and flies more predictably. By having this type of launching and braking system the operator can feel and gauge the power of the kite, and stop or adjust the rate of control-line release and the kite altitude, based on the operator's skill, comfort level, and/or desired kite altitude.

The altitude selected for kite flying may be important for kite handling. Thus, the control lines may be marked at defined intervals to help the operator keep track of the length of line that has been released. For example, if a kite is flown comparatively at 20 and 27 meters, at 20 meters the kite will respond more quickly, because there is less drag on the control lines. Thus, an operator may elect a kite altitude based on the desired speed of response. This ability to control kite altitude and length, offered by a variable-line controller, may be especially helpful with larger kites, since they move through the wind window more slowly.

Once a desired kite altitude and/or length of extended control line has been reached, the kite operator readies the controller and control lines for kiteboarding. The spool bar may be fixed in position by activating locking mechanism 140 (see Section II.B), and the operator's hands generally are re-positioned to handle portion 86 at this time.

C. Sheeting the Kite

The kite operator may select a sheeting system and controller linkage suited to personal preference; see FIGS. 7–12, and 18. If the kite operator is attached to a harness bridle, the kite may be sheeted to a desired pitch by pulling sheeting loop 212 a desired amount toward the operator and then uni-directionally fixing this position by activating cleating mechanism 240, specifically cleat arm 244. This cleat arm prevents kiteward movement of the sheeting line. At any time, the kite may be depowered further by pulling sheeting loop 212 toward the operator without changing position of the cleating mechanism. However, if the kite operator prefers to be attached to the controller by attaching the harness to the sheeting loop, cleat arm 242 may be activated. In this case, the kite operator provides resistance for kiteward movement of the sheeting line. Thus, at any time, sheeting may be reduced (and the kite power increased) by bringing the controller toward the operator. Alternatively, the operator may ride without either cleating arm activated, but linked to the sheeting loop. In this case, movement of the controller toward or away from the operator will decrease or increase sheeting, respectively. Additional aspects of sheeting mechanisms, cleating mechanisms, and operator linkage to sheeting mechanisms are described above in Section II.C.

D. Landing the Kite and Retrieving Control Lines

Figure 28:
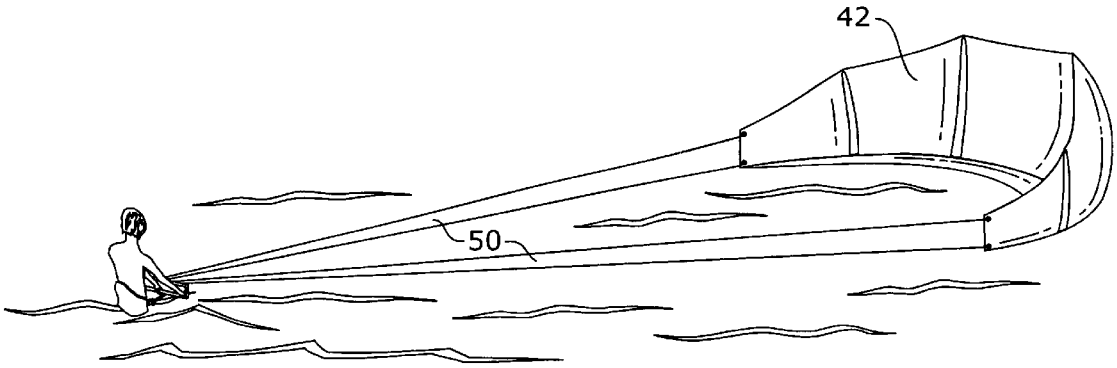
FIG. 28 is a view of landing a kite with a fixed- or variable-line kite control system, in preparation for winding the control lines onto a control bar, in accordance with aspects of the invention.

This section describes how the kite may be landed and the control lines retrieved; see FIG. 28. To land the kite, the operator may fly the kite to the edge of the wind window, dump the kite by turning it upside down, then let it drift directly downwind. The operator then flips the controller over to remove twist in control lines 50. The inverted kite is now greatly depowered and in a position safe from spontaneous re-launching. With variable-line controller 80, the crank may be released by extending handle 182 out of engagement with the frame. The crank may then be used to rotate the spool bar, thus retrieving the line (see Section II.B). By staying hooked into the harness line, the operator has added leverage while winding the crank. The operator can stop winding the crank at any time and lock the handle when necessary. With a fixed-line controller, the operator may wind the lines around the winding posts.

VII. Comparison of Two-Line and Four-Line Kite Control Systems

This section compares aspects of two-line and four-line kite control systems.

A. Two-Line Systems

For simplicity a two-line kite control system makes sense, particularly where wind speeds are constant, such as trade winds. A bridle system supports a kite so that it can be controlled with only two lines. However, a two-line kite retains its amount of exerted force throughout its flight path within the wind window. Thus, the conveyance means becomes important in controlling the amount of force or pull exerted by the kite. In this case, a board with sufficient surface area, a tracking fin, and an effective edge may be important.

With two-line kiteboarding the board may work by using the board's edge, creating resistance to the pull of the kite. By this action, one can move the kite to the edge of the wind window, thus reducing the exerted force of the kite and allowing the rider to maneuver. Other means of kite control may include flying the kite in the upper area of the wind window, from the 11:00 to 1:00 range. This may give the rider time to maneuver without being overpowered.

B. Four-Line Kite Control Systems

Four-line kite control systems may take the kiteboarder to a higher performance level, with the addition of sheeting lines and a sheeting mechanism. The sheeting lines also may eliminate the need for a bridle system. A sheeting mechanism may be used to control the sheeting lines in at least two different methods. 1) The kiteboarder is hooked into a harness bridle, and adjusts the kite by pulling the sheeting regulator and fixes its position with a cleating mechanism. This may depower the kite slightly or a great amount, but not totally. Then the kiteboarder may ride at a desired comfort level. 2) A rider may hook into a sheeting loop and perform all the actions while in the loop. The advantages of the sheeting loop may be that the rider can constantly adjust the exerted force of the kite, with changing wind velocities.

VIII Further Examples of Kite Control Systems

The following numbered paragraphs illustrate without limitation further aspects of the invention.

1. A device for controlling a power kite, comprising 1) a frame having a handle portion adapted to be grasped by a person's hand; and 2) an elongate spool bar coupled to the handle portion and rotatable about an axis of rotation, where the spool bar includes plural spools dimensioned to hold power-kite control lines, and the handle portion has a long axis that is spaced from the axis of rotation.

2. The device of paragraph 1, where the frame includes end regions flanking the handle portion, the end regions coupling the spool bar to the handle portion.

3. The device of paragraph 2, where the end regions extend generally orthogonal to the handle portion.

4. The device of paragraph 1, where the handle portion is at least substantially parallel to the spool bar.

5. The device of paragraph 1, where the frame and the spool bar form a generally trapezoidal structure.

6. The device of paragraph 1, where the plural spools include at least three spools.

7. The device of paragraph 1, where the plural spools include at least four spools.

8. The device of paragraph 1, where the plural spools include at least three spools that are fixedly mounted relative to each other.

9. The device of paragraph 1, where the spool bar includes at least one brake region dimensioned to be grasped by a person's hand, the brake region being fixedly mounted on the spool bar.

10. The device of paragraph 1, further comprising a crank mechanism having a rotatable arm, rotation of the arm being selectably coupled to rotation of the spool bar.

11. The device of paragraph 1, further comprising a crank mechanism coupled to the frame, where the crank mechanism includes a storage position, and the storage position engages the crank mechanism with the frame, thereby blocking rotation of the crank mechanism.

12. The device of paragraph 1, further comprising a crank mechanism that rotates the spool bar, the crank mechanism having a storage position in which the crank mechanism is not rotatable.

13. The device of paragraph 1, further comprising a sheeting mechanism, the sheeting mechanism being adapted to independently control the deployed length of a control line extending from at least one of the plural spools.

14. A device for controlling a power kite, comprising 1) a frame having a handle portion; and 2) a spool bar coupled to the frame, the spool bar having a rotational axis generally parallel to the handle portion, where the spool bar includes plural spools dimensioned for holding power-kite control lines, and the spool bar is adapted to be generally kiteward of the handle portion when controlling a kite.

15. The device of paragraph 14, where the spool bar includes at least one brake region adapted to be grasped by a person's hand, and the brake region and the spool bar are generally coaxial.

16. The device of paragraph 14, where the plural spools include at least four spools.

17. The device of paragraph 14, further comprising a crank mechanism that rotates the spool bar, where the spool bar includes an end portion, the end portion being selectably coupled to the crank mechanism.

18. A device for controlling a power kite, comprising 1) a frame having a graspable handle portion; 2) a spool bar rotatably coupled to the frame, the spool bar including at least three spools dimensioned for holding power-kite control lines; and 3) a sheeting mechanism adapted to positively and negatively change the deployed length of a subset of the power-kite control lines, independent of the deployed length of the remaining control lines.

19. A device for controlling a power kite, comprising 1) a frame having a graspable handle portion; 2) a spool mechanism operatively associated with the frame, where the spool mechanism is adapted to hold and cooperatively deploy at least three control lines for tethering to separate positions on the kite; and 3) a sheeting mechanism adapted to positively and/or negatively adjust the deployed length of a subset of the at least three control lines, independent of the deployed length of the remaining control lines.

20. The device of paragraph 19, where the sheeting mechanism includes a sheeting regulator, and movement of the sheeting regulator toward and away from the kite regulates the sheeting mechanism.

21. The device of paragraph 19, where the sheeting mechanism is functional while each of the at least three spools is stationary.

22. The device of paragraph 19, where the sheeting mechanism includes a sheeting spool that rotates independently of each of the at least three spools.

23. The device of paragraph 19, where the sheeting mechanism includes an independently rotatable sheeting spool that is at least partially concentric with at least one of the at least three spools.

24. The device of paragraph 19, where the sheeting mechanism includes a cleating mechanism, the cleating mechanism being adapted to block at least one of a positive and a negative change in deployed length of a control line.

25. The device of paragraph 24, where the cleating mechanism is attached to the handle portion.

26. A device for controlling power kites, comprising 1) a handle portion having at least three attachment structures adapted for coupling to at least three power-kite control lines, the handle portion controlling the spatial positions of the at least three attachment structures; and 2) a sheeting mechanism attached to the handle portion and adapted for positively and negatively changing the effective length of at least one power-kite control line independently from the other lines.

27. The device of paragraph 26, where the sheeting mechanism includes a sheeting regulator, and movement of the sheeting regulator both toward and away from the kite changes the effective length.

28. The device of paragraph 27, where the sheeting regulator is coupled to the at least one power-kite control line by direct attachment, a pulley mechanism, or a sheeting spool.

29. The device of paragraph 26, where the sheeting mechanism includes a cleating mechanism, the cleating mechanism being adapted to selectably and at least uni-directionally block changing the effective length.

30. The device of paragraph 26, where the sheeting mechanism includes a structure for coupling to a harness.

31. A method of launching and adjusting line length for a power kite tethered by control lines, where the control lines are at least partially housed on a spool bar that has rotatable and locking configurations, and the spool bar includes a brake region fixedly mounted on the spool bar and adapted to be grasped by a user, the method comprising 1) grasping the brake region with a gripping pressure using at least one hand; 2) unlocking the spool bar to allow rotation; and 3) adjusting the gripping pressure to regulate rate of spool bar rotation, thereby controlling rate of control line extension.

32. The method of paragraph 31, where the kite control system includes a handle portion coupled to the spool bar, the spool bar defines an axis of rotation, and the handle portion has long axis that is spaced from the axis of rotation.

33. The method of paragraph 32, where the handle portion is generally parallel to the brake region.

34. A method of sheeting a power kite, the power kite being tethered by at least three control lines coupled to a kite control bar, where the bar includes a sheeting mechanism having a sheeting regulator, and movement of the sheeting regulator toward and away from the kite positively and negatively controls the effective length of at least one of the three control lines relative to the other control lines, comprising 1) attaching the sheeting regulator to at least one of the control bar and a user; and 2) adjusting the sheeting regulator longitudinally.

35. The method of paragraph 34, where the sheeting regulator is coupled to a harness.

36. The method of paragraph 34, where the sheeting regulator is attached to the control bar using a cleating mechanism.

37. The method of paragraph 36, where the cleating mechanism at least uni-directionally blocks movement of the sheeting regulator.

38. The method of paragraph 34, where the sheeting regulator is coupled through a mechanism that is selected from the group consisting of direct attachments, pulley mechanisms, and spool mechanisms.

The disclosure set forth above may encompass multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and nonobvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements. It is believed that the following claims particularly point out certain combinations and subcombinations that are directed to one of the disclosed inventions and are novel and nonobvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

I claim:

1. A device for controlling a power kite, comprising:

a graspable handle portion;

a deployment mechanism adapted to hold and deploy at least three control lines that operatively tether the handle portion to separate positions on the kite, the deployment mechanism including a plurality of control spools for holding the three control lines; and a sheeting mechanism adapted to positively and negatively adjust the deployed length of a subset of the at least three control lines, independent of the deployed length of the remaining control lines, where the sheeting mechanism is functional while all of the control spools are stationary.

2. The device of claim 1, where the deployment mechanism includes a separate control spool for each of the at least three control lines.

3. The device of claim 2, where the separate spools are rotationally coupled so that they turn together without slippage.

4. The device of claim 1, where the deployment mechanism is at least generally kiteward of the graspable handle portion while controlling the kite.

5. The device of claim 1, where the sheeting mechanism includes a sheeting spool for taking up or releasing a portion of the deployed length of at least one of the subset of the at least three control lines.

6. The device of claim 5, where the control spools and the sheeting spool share a common rotation axis.

7. The device of claim 5, where the sheeting spool rotates independently of the control spools.

8. The device of claim 5, where the sheeting spool forms a housing for at least one of the control spools.

9. The device of claim 1, the sheeting mechanism including a sheeting regulator, where the sheeting mechanism is regulated by movement of the sheeting regulator toward and away from the kite.

10. The device of claim 1, where the sheeting mechanism includes a cleating mechanism adapted to block at least one of positively and negatively changing the deployed length of a control line.

11. The device of claim 10, where the cleating mechanism is attached to the handle portion.

12. The device of claim 1, further comprising a brake mechanism adapted to retard or stop deployment of the control lines.

13. The device of claim 12, where the brake mechanism includes a control region configured to be grasped by a hand.

14. The device of claim 1, the deployment mechanism being rotatable, further comprising a crank mechanism having a rotatable arm, where rotation of the arm is selectably coupled to rotation of the deployment mechanism.

15. The device of claim 1, where the deployment mechanism is adapted to hold and deploy at least four control lines.

16. The device of claim 1, where the sheeting mechanism is adapted to adjust the deployed length of at least two control lines.

17. A method for controlling a power kite, comprising:

providing a control device adapted to hold and deploy at least three control lines on a plurality of control spools to operatively tether the handle portion to separate positions on the kite, the control device having a sheeting mechanism adapted to positively and negatively adjust the deployed length of a subset of the at least three control lines, independent of the deployed length of the remaining control lines;

connecting the control device to the kite using the at least three control lines;

launching the kite into the air; and adjusting the deployed length of the subset of the at least three control lines with the sheeting mechanism while the control spools are all stationary, thereby controlling the kite.

18. The method of claim 17, the sheeting mechanism being regulated by movement of the sheeting regulator toward and away from the kite, where the step of adjusting includes moving the sheeting regulator toward or away from the kite.

19. A device for controlling a power kite, comprising:

a graspable handle portion;

means for holding and deploying at least three control lines that operatively tether the handle portion to separate positions on the kite; and sheeting mechanism means or positively and negatively adjusting the deployed length of a subset of the at least three control lines, independent of the deployed length of the remaining control lines, while the holding and deploying means is stationary.

20. A device for controlling a power kite, comprising:

a graspable handle portion;

a deployment mechanism adapted to hold and deploy at least three control lines that operatively tether the handle portion to separate positions on the kite; and a sheeting mechanism adapted to positively and negatively adjust the deployed length of a subset of the at least three control lines, independent of the deployed length of the remaining control lines, the sheeting mechanism including a sheeting regulator having an end portion, the sheeting regulator controlling the sheeting mechanism by translational movement of end portion.

21. The device of claim 10, the sheeting mechanism including a pulley opposingly rotated by tension on at least one control line and on the sheeting regulator.

22. The device of claim 10, where the sheeting regulator is selected from the group consisting of a line, a cord, a strip, and a belt.

23. The device of claim 10, the end portion of the sheeting regulator being configured to be attached to at least one of a harness and the handle portion.

* * * * *